US011635245B2

(12) United States Patent
Seo et al.

(10) Patent No.: US 11,635,245 B2
(45) Date of Patent: Apr. 25, 2023

(54) PAIR INSTALLATION TYPE REFRIGERATOR

(71) Applicant: LG Electronics Inc., Seoul (KR)

(72) Inventors: Hyunwoo Seo, Seoul (KR); Jinho Kim, Seoul (KR); Taejin Yeom, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 167 days.

(21) Appl. No.: 17/125,041

(22) Filed: Dec. 17, 2020

(65) Prior Publication Data

US 2021/0190406 A1 Jun. 24, 2021

(30) Foreign Application Priority Data

Dec. 23, 2019 (KR) ..... 10-2019-0173148
Feb. 28, 2020 (KR) ..... 10-2020-0025203

(51) Int. Cl.
*F25D 11/02* (2006.01)
*F25D 23/00* (2006.01)
*F25D 23/06* (2006.01)

(52) U.S. Cl.
CPC ..... *F25D 11/02* (2013.01); *F25D 23/00* (2013.01); *F25D 23/06* (2013.01); *F25D 2323/00* (2013.01); *F25D 2500/02* (2013.01)

(58) Field of Classification Search
CPC ..... F25D 23/10; F25D 23/065; F25D 23/068; F25D 2323/002; F25D 2323/0021; F25D 2323/0026; F25D 2323/00268; A47F 3/0426; A47F 3/0434
See application file for complete search history.

(56) References Cited

FOREIGN PATENT DOCUMENTS

| | | | | |
|---|---|---|---|---|
| DE | 20209516 | | 10/2003 | |
| DE | 102013015414 | | 2/2015 | |
| DE | 102013015414 | A1 * | 2/2015 | ..... F25D 21/04 |
| JP | S4523088 | | 9/1970 | |
| JP | H02136678 | | 5/1990 | |
| JP | H05164458 | A * | 6/1993 | |
| KR | 1020130084071 | | 7/2013 | |
| WO | WO 2004001305 | | 12/2003 | |
| WO | WO-2004001305 | A1 * | 12/2003 | ..... F25D 21/04 |

OTHER PUBLICATIONS

EP Extended European Search Report in European Appln. No. 20216561.9, dated May 26, 2021, 9 pages.

* cited by examiner

*Primary Examiner* — Ana M Vazquez
(74) *Attorney, Agent, or Firm* — Fish & Richardson P.C.

(57) ABSTRACT

A pair installation type of refrigerator system provides a plurality of refrigerators installed in parallel. A first refrigerator includes a first discharge portion formed on a side wall of the first cabinet to communicate with a first machine room, and a flow guide detachably coupled to the side wall of the first cabinet to cover the first discharge portion. A second refrigerator includes a second door that is opened such that an opening direction is symmetrical to that of the first door in a state in which the second refrigerator is disposed adjacent to the first refrigerator, and a decor member disposed in a space between the first refrigerator and the second refrigerator to shield a front side in a state in which the second refrigerator is disposed adjacent to the first refrigerator. The decor member fixes the first cabinet and a second cabinet.

18 Claims, 18 Drawing Sheets

PAIR INSTALLATION TYPE REFRIGERATOR

CROSS-REFERENCE TO RELATED APPLICATIONS

This application claims the benefit of Korean Patent Application No. 10-2019-0173148, filed on Dec. 23, 2019 and Korean Patent Application No. 10-2020-0025203, filed on Feb. 28, 2020. The disclosures of the prior applications are incorporated by reference in their entirety.

TECHNICAL FIELD

The present disclosure relates to a pair installation type refrigerator.

BACKGROUND

In general, a refrigerator is an appliance that allows low-temperature storage of food in an internal storage space that is shielded by a door. To this end, the refrigerator is configured to store food in an optimal state by cooling the inside of the storage space using cold air generated through heat exchange with a refrigerant circulating through a refreezing cycle.

In general, dew condensation phenomenon occurs because moisture contained in air having relatively high humidity outside the refrigerator condenses on a surface of the refrigerator, resulting in condensation as the temperature and humidity of the inside of the refrigerator are lower than the temperature and humidity of the outside of the refrigerator.

In addition, recent refrigerators include two or more refrigerators that are connected in parallel, or two refrigerators and one freezer, two refrigerators and two freezers, or the like are combined as needed according to users' needs of improved installation spaces, usage purposes, capacities, or the like. Further, built-in refrigerators are being developed.

However, when two or more refrigerators are arranged in parallel and a distance between refrigerators is small or when the refrigerator is installed close to a wall such as a built-in refrigerator, the dew point is lowered as the convection coefficient decreases, resulting in dew condensation.

In addition, when two or more refrigerators are installed in parallel, the refrigerators need to be installed at a certain distance such that air in the refrigerators can be discharged to the outside. In this case, external particles may be introduced into the gap between the refrigerators. Further, the space between the refrigerators is exposed to the outside, degrading an appearance of the refrigerators.

Some refrigerators provide solutions for evaporating and removing dew condensed on a front portion in which a refrigerator body and a door contact each other, due to heat radiation of a refrigerant by allowing the refrigerant having a certain pressure and a certain temperature to flow along a hot line connected with one of elements constituting a freezing cycle and installed on the front surface of a refrigerator in a shape of a closed loop.

However, in such solutions, when refrigerators are installed in parallel or close to a wall, it is not effective in preventing the condensation of dew on the side of the refrigerators. In addition, when the hot line is mounted on a side of a refrigerator, a separate material is required, which costs more. Further, a problem of power consumption may occur.

In addition, some built-in type refrigerators include a fixing structure that installs a decoration panel on the front surface of a door case by fixing it to the upper surface of the decoration panel with a screw without generating a screw fastening hole.

However, in these solutions, when two or more refrigerators are installed in parallel, they lack unity in appearance, and need a complicating fixing structure.

SUMMARY

Implementations of the present disclosure provide a refrigerator in which the dew condensation phenomenon occurring on a side of a refrigerator is restricted when refrigerators are arranged in parallel at a distance or close to a wall.

Implementations of the present disclosure provide refrigerators having a beautiful appearance that generates a sense of unity in appearance while shielding a space between the refrigerators when the refrigerators are arranged in a row at a distance.

Particular implementations of the present disclosure provide a refrigerator system that includes first and second refrigerators and a decor. The first refrigerator may include a first cabinet, a first door, a first hinge, a first machine room, a first discharge portion, and a flow guide. The first cabinet defines a first storage space. The first door is configured to open and close the first storage space. The first hinge is coupled to the first cabinet and configured to rotate the first door relative to the first cabinet. The first machine room is disposed under the first cabinet. The first discharge portion is disposed at a first side wall of the first cabinet and in fluid communication with the first machine room. The flow guide is detachably coupled to the first side wall of the first cabinet and covering the first discharge portion. The second refrigerator may include a second cabinet, a second door, a second hinge, a second machine room, and a second discharge portion. The second cabinet is spaced apart from the first cabinet and defining a second storage space. The second door is configured to open and close the second storage space. The second hinge is coupled to the second cabinet and configured to rotate the second door relative to the second cabinet. The second door is configured to open symmetrically to an opening direction of the first door. The second machine room is disposed under the second cabinet. The second discharge portion is disposed at a second side wall of the second cabinet and in fluid communication with the second machine room. The decor is configured to be disposed between the first refrigerator and the second refrigerator and shield a front side of the first refrigerator and the second refrigerator that are disposed side by side. The first cabinet and the second cabinet are each fixed to an upper portion of the decor.

In some implementations, the refrigeration system can optionally include one or more of the following features. The flow guide may be open upward and configured to guide air discharged from the first discharge portion upward along the first side wall of the first cabinet. The flow guide may include a guide body, and a guide inner surface that faces the first discharge portion and is configured to guide the air discharged from the discharge portion toward an upper portion of the first cabinet. The guide body may include (i) a first edge portion that defines a bottom surface of the flow guide and (ii) a second edge portion and a third edge portion that extend upward from the first edge portion at opposite sides of the flow guide and define side surfaces of the flow guide. The flow guide may include a sealing frame that protrudes from the guide inner surface and may be spaced apart from the first, second, and third edge portions of the guide body. A sealing member may be disposed between the sealing frame and the first, second, and third edge portions of the guide body. The flow guide may include a restrainer that protrudes from the guide inner surface and that is configured to connect the flow guide and the first discharge portion. The flow guide may include an insertion guide protruding toward the guide inner surface and contacting an end of the discharge portion to guide a direction in which the flow guide is inserted into the discharge portion. The flow guide may protrude from the guide inner surface and include a guide rib that extends in a direction crossing the first edge portion of the guide body. The guide rib may include first, second, third, and fourth guide rib portions. The first guide rib portion may be perpendicular or inclined to the first edge portion. The second guide rib portion may have an obtuse angle with respect to the first edge portion. The third guide rib portion may be perpendicular or inclined to the first edge portion. The fourth guide rib portion may have an acute angle with the first edge portion. The decor may include an insertion portion configured to be disposed between the first refrigerator and the second refrigerator, and a shielding portion (i) extending from a front end of the insertion portion to opposite sides of the insertion portion and (ii) supported at a front surface of the first cabinet and a front surface of the second cabinet. The insertion portion may include a through portion that is in fluid communication with an upper end and a lower end of the insertion portion. The insertion portion may include front, side, rear, and central portions. The front portion may define a front surface of the insertion portion. The side portion may extend away from the front portion and defining the opposite sides of the insertion portion. The rear portion may be connected to the side portion and defining a rear portion of the insertion portion. The central portion may extend away from a center of the front portion and connected to a center of the rear portion. The central portion may define a support hole that extends from an upper end of the central portion to a lower end of the central portion. The decor may include side ribs protruding outward from the opposite sides of the insertion portion. Each of the side ribs may be inclined toward the shielding portion as it extends from one of the opposite sides of the insertion portion. The first refrigerator may include a first lower cover that is disposed at a lower end of a front surface of the first cabinet. The first lower cover may a first coupling portion extending parallel with a lower end of the first cabinet and coupled to the first cabinet, and a first lower surface portion protruding forward from a lower end of the first coupling portion. The second refrigerator may include a second lower cover that is disposed at a lower end of a front surface of the second cabinet. The second lower cover may include a second coupling portion extending parallel with a lower end of the second cabinet and coupled to the second cabinet, and a second lower surface portion protruding forward from a lower end of the second coupling portion. The refrigerator system may include a front bracket that is coupled to the first lower cover and the second lower cover at opposite ends of the front bracket, and that is configured to fix the first and second cabinets and maintain a set distance between the first and second cabinets. The refrigerator system may include a top bracket configured to shield a space between the first cabinet and the second cabinet at a top of the space. The top bracket may be configured to be coupled to an upper surface of the first cabinet and an upper surface of the second cabinet and maintain the first and second cabinets at a set distance. The top bracket may include a bracket body extending along the space between the first and second cabinets, and a bracket coupling portion extending from a rear end of the bracket body to opposite sides of the bracket body and coupled to the first cabinet and the second cabinet. The top bracket may include a bent portion extending upward from a front end of the bracket body and contacting the decor. The decor may include a rear decor that protrudes rearward from a rear end of an insertion portion and that defines a connection hole that is fluidly connected to the top bracket. The top bracket may define a bracket connection hole. A screw may be fastened through the connection hole and the bracket connection hole.

According to an implementation, a pair installation type refrigerator having a structure in which a plurality of refrigerators are installed in parallel includes a first refrigerator including a first cabinet having a first storage space formed therein; a first door configured to open and close the first storage space; a first hinge coupled to the first cabinet such that the first door is rotatable; a first machine room formed under the first cabinet; a first discharge portion formed on a side wall of the first cabinet to communicate with the first machine room; a flow guide detachably coupled to the side wall of the first cabinet to cover the first discharge portion, and a second refrigerator including: a second cabinet spaced apart from the first cabinet having a second storage space formed therein; a second door configured to open and close the second storage space; a second hinge coupled to the second cabinet such that the second door is opened symmetrically to an opening direction of the first door; a second machine room formed under the second cabinet; a second discharge portion formed on a side wall of the second cabinet to communicate with the second machine room; and a decor member disposed in a space between the first refrigerator and the second refrigerator to shield a front side in a state in which the first refrigerator and the second refrigerator are disposed adjacent to each other, wherein the decor member individually fixes the first cabinet and the second cabinet at an upper portion thereof.

The flow guide may be open upward to guide air discharged from the discharge portion so as to flow upward along a side of the first cabinet.

The flow guide may include a guide body configured to form an edge, and a guide inner surface configured to face the discharge portion and guide the air discharged from the discharge portion toward an upper portion of the cabinet, and the guide body may include a first edge portion forming a bottom surface of the flow guide and a second edge portion and a third edge portion extending upward from the first edge portion at both sides of the flow guide to form side surfaces.

The flow guide may include a sealing frame protruding from the guide inner surface and spaced apart from the edge portions of the guide body in a center direction of the guide inner surface, and a sealing member may be provided between the edge portions of the guide body and the sealing frame.

The flow guide may include a restraining mechanism protruding from the guide inner surface to connect the flow guide and the discharge portion.

The flow guide may include an insertion guide protruding toward the guide inner surface and contacting an end of the discharge portion to guide a direction in which the flow guide is inserted into the discharge portion.

The flow guide may protrude from the guide inner surface and include a guide rib extending in a direction crossing the first edge portion of the guide body.

The guide rib may include a first guide rib formed to be perpendicular or inclined to the first edge portion; a second guide rib having an obtuse angle with the first edge portion; a third guide rib formed to be perpendicular or inclined to the first edge portion; and a fourth guide rib having an acute angle with the first edge portion.

The decor member may include an insertion portion disposed in the space between the first refrigerator and the second refrigerator, and a shielding portion extending from a front end of the insertion portion to both sides and supported on a front surface of the first cabinet and a front surface of the second cabinet.

The insertion portion may include a through portion communicating an upper end and a lower end.

The insertion portion may include a front portion defining a front surface of the insertion portion; a side portion extending rearward from the front portion to define both sides of the insertion portion; a rear portion connected to the side portion to define a rear portion of the insertion portion; and a central portion extending rearward from a center of the front portion and connected to a center of the rear portion.

The central portion may further include a support hole formed to pass through from an upper end to a lower end of the central portion.

The decor member may include side ribs protruding outward from both sides of the insertion portion.

Each of the side ribs may have an inclination to be closer to a front surface of the insertion portion as it goes toward both ends of the side rib.

The first cabinet may be installed with a first lower cover at a lower end of a front surface of the first cabinet, the first lower cover may include a first coupling portion extending horizontally with respect to a lower end of the first cabinet and coupled to the first cabinet, and a first lower surface portion protruding forward from a lower end of the first coupling portion, the second cabinet may be installed with a first lower cover at a lower end of a front surface of the second cabinet, and the second lower cover may include a second coupling portion extending horizontally with respect to a lower end of the second cabinet and coupled to the second cabinet, and a second lower surface portion protruding forward from a lower end of the second coupling portion.

The pair installation type refrigerator may further include a front bracket coupled to the first lower cover and the second lower cover at both ends thereof, to fix the first and second cabinets to maintain a set distance.

The pair installation type refrigerator may further include a top bracket configured to shield a space between the first cabinet and the second cabinet in a front-rear direction from a top of the space, and the top bracket may be coupled to an upper surface of the first cabinet and an upper surface of the second cabinet to maintain the first and second cabinets at a set distance.

The top bracket may include a bracket body extending along the space between the first and second cabinets, and a bracket coupling portion extending from a rear end of the bracket body to both sides and coupled to the first cabinet and the second cabinet.

The top bracket may further include a bent portion bent and extending upward from a front end of the bracket body and contacting the decor member.

The decor member may include a rear decor formed to protrude rearward from a rear end of the insertion portion and having a connection hole connected to the top bracket, and the top bracket may include a bracket connection hole through which a screw is fastened through the connection hole.

DETAILED DESCRIPTION

Figure 1:
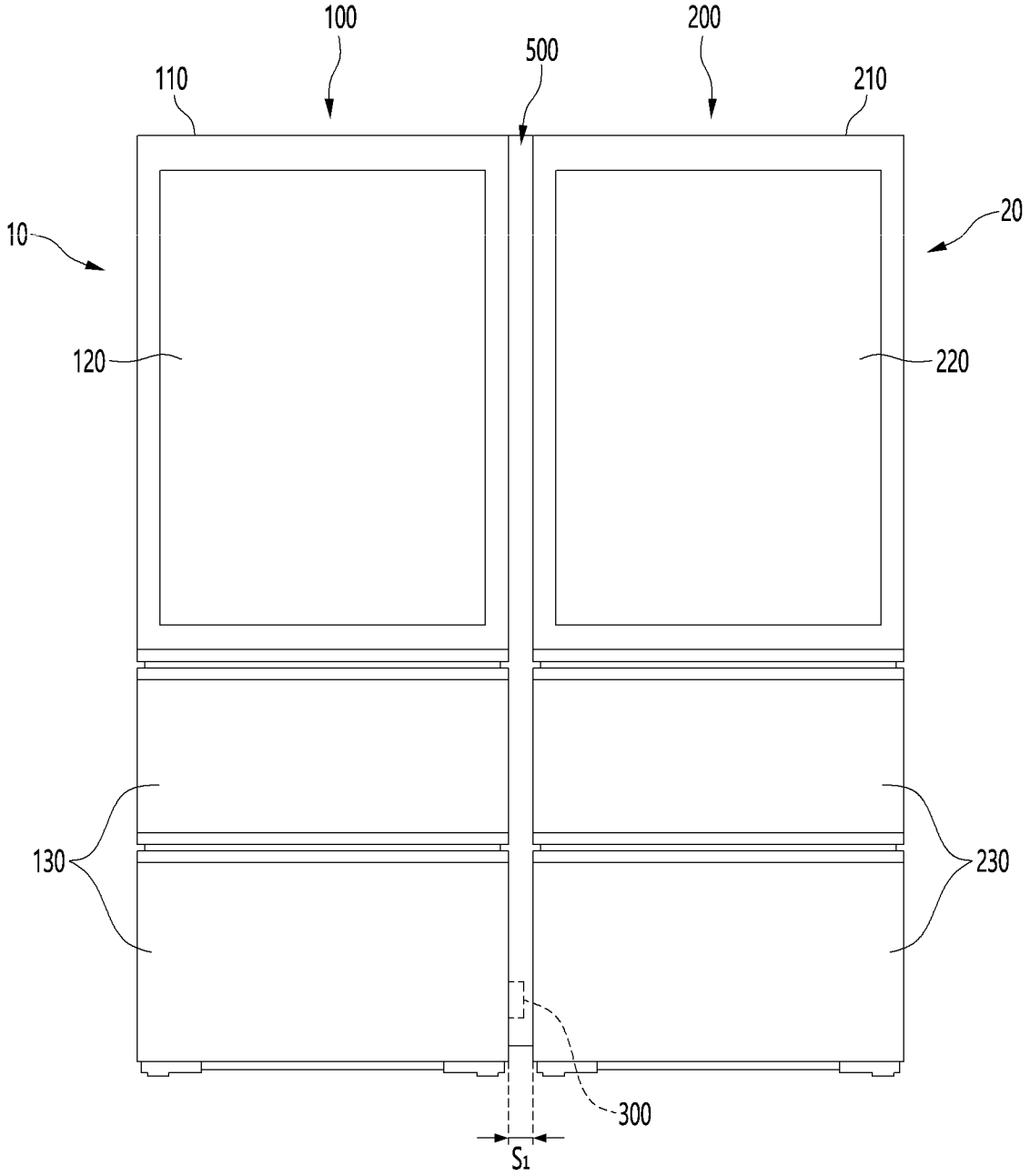
FIG. 1 is a front view showing a refrigerator according to an implementation of the present disclosure.

Exemplary implementations of the present disclosure will be described below in detail with reference to the accompanying drawings in which the same reference numbers are used throughout this specification to refer to the same or like parts. In describing the present disclosure, a detailed description of known functions and configurations will be omitted when it may obscure the subject matter of the present disclosure.

Hereinafter, a pair installation type refrigerator system in which a first refrigerator 100 and a second refrigerator 200 are fixed to each other according to an implementation of the present disclosure will be described in detail with reference to the accompanying drawings.

Since the implementations described in the present specification and the configurations shown in the drawings are some of preferred implementations of the present disclosure and do not represent all the technical spirit of the present disclosure, there may be various equivalents and modifications.

Figure 2:
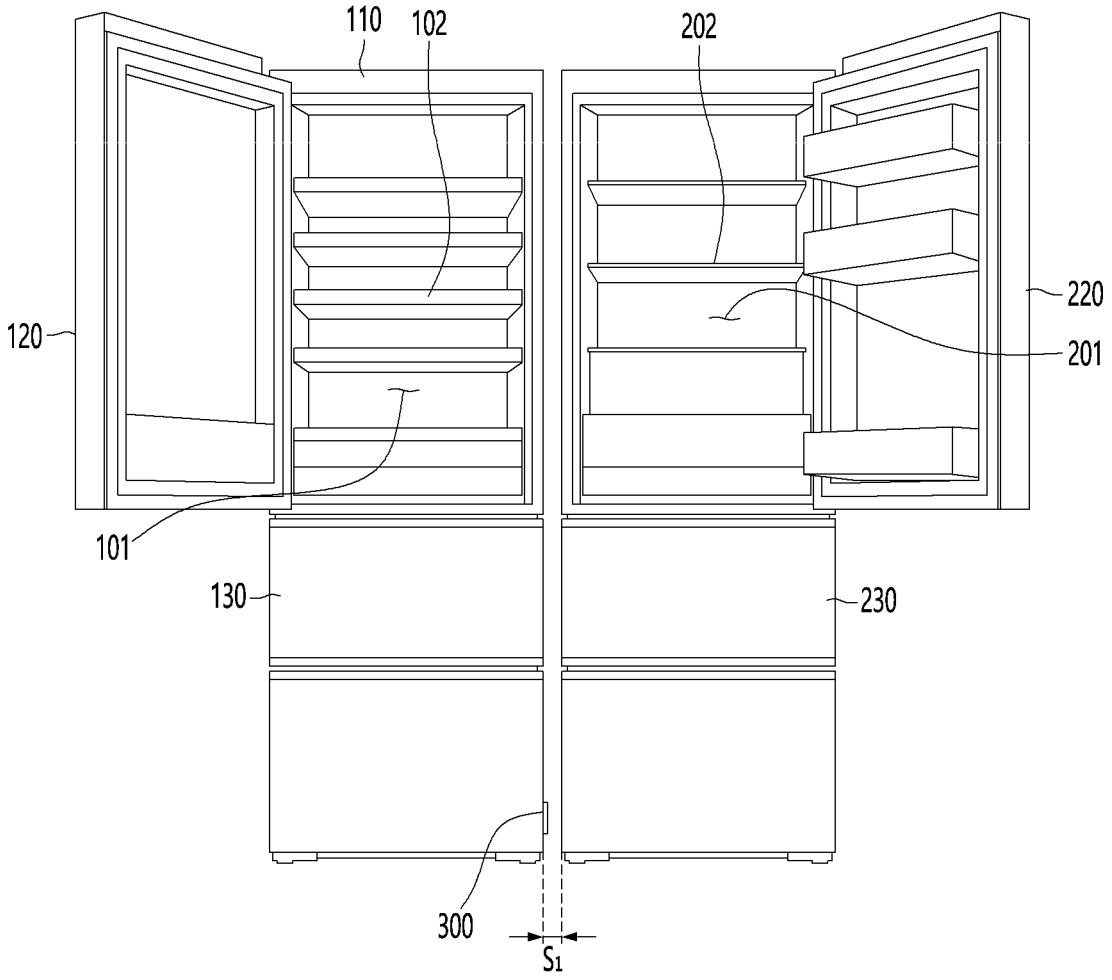
FIG. 2 is a front view showing the refrigerator of which a door is opened according to an implementation of the present disclosure.
Figure 3:
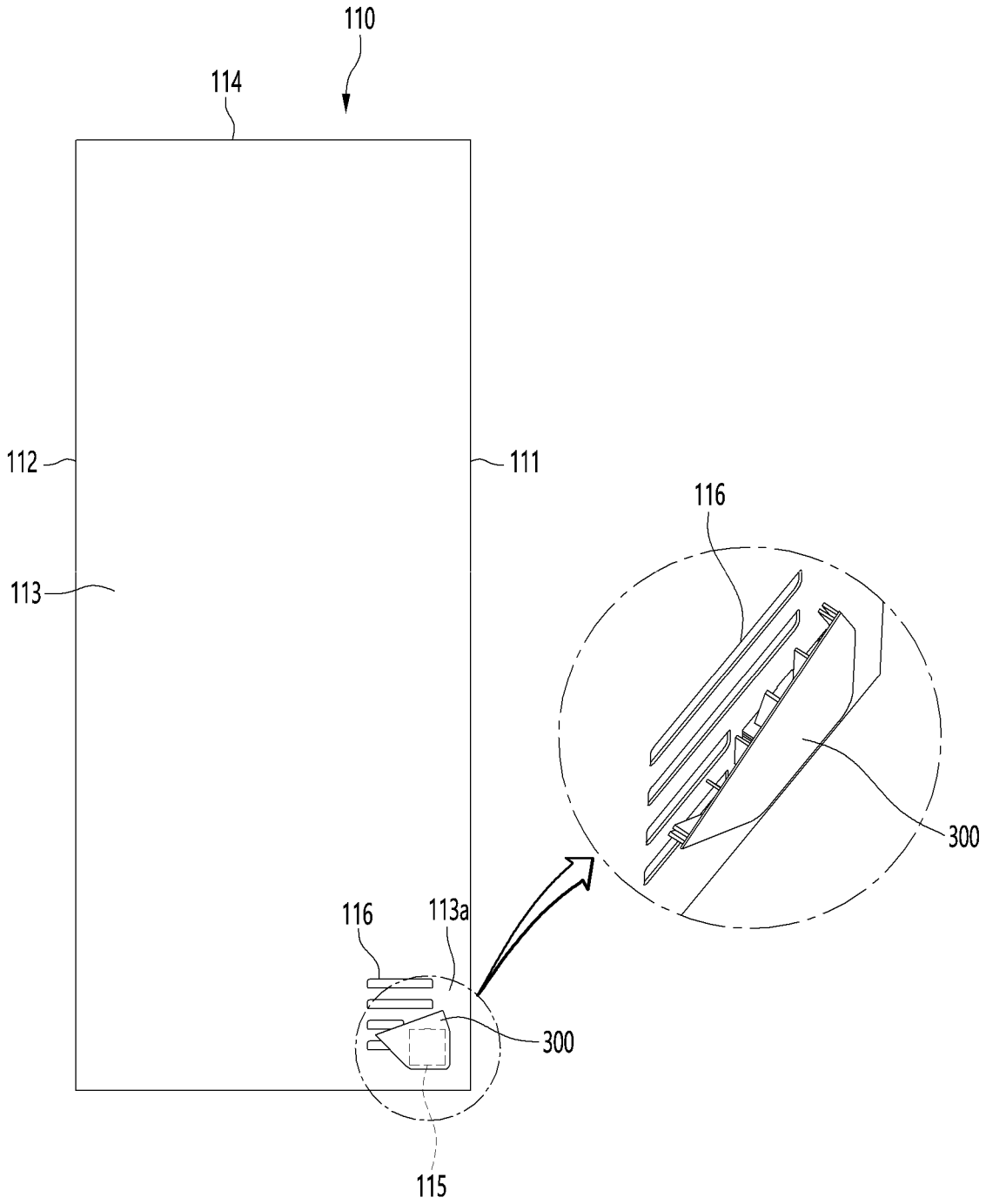
FIG. 3 is a side view showing one side of the refrigerator according to an implementation of the present disclosure.
Figure 4:
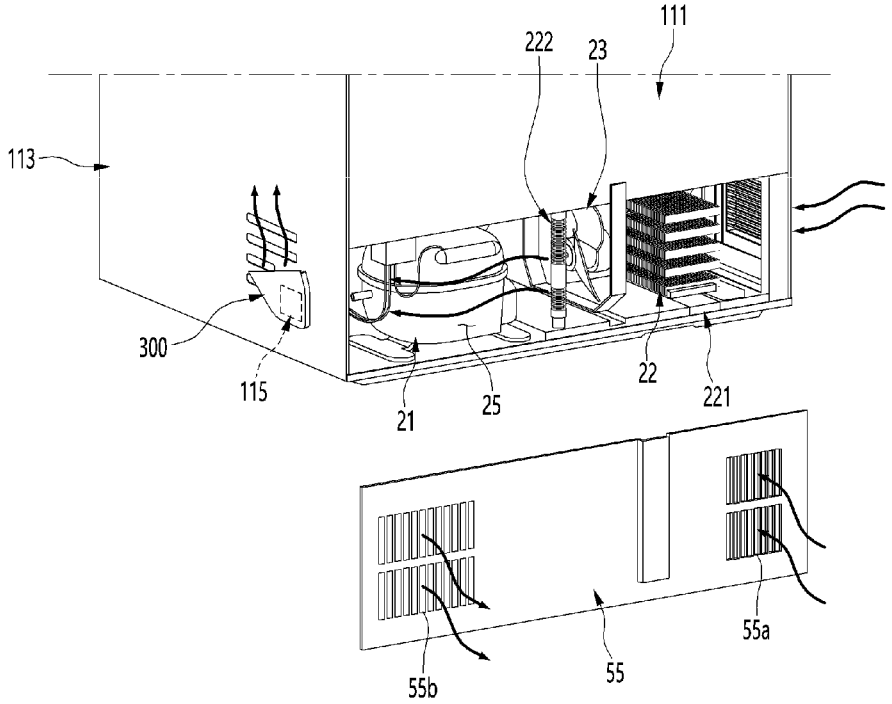
FIG. 4 is a partial perspective view showing a space inside a machine room of the refrigerator.

FIG. 1 is a front view showing a refrigerator according to an implementation of the present disclosure. Further, FIG. 2 is a front view showing the refrigerator of which a door is opened according to an implementation of the present disclosure. Further, FIG. 3 is a side view showing one side of the refrigerator according to an implementation of the present disclosure. Further, FIG. 4 is a partial perspective view showing a space inside a machine room of the refrigerator.

As shown in FIGS. 1 to 3, a surface on which the doors 120 and 220 are provided can be defined as a front surface 112 and a front side with respect to a cabinet of the first refrigerator 100. A surface contacting the floor can be defined as a bottom surface. A surface facing the bottom surface can be defined as the top surface 114 and the top side. A surface facing the door can be defined as the rear surface 111 and the rear side.

As shown in the drawings, a pair installation type refrigerator according to an implementation of the present disclosure may include the first refrigerator 100 including a first cabinet 10 in which a storage chamber is formed, and the second refrigerator 200 installed side by side of the first refrigerator and a second cabinet 20 in which a storage chamber is formed.

That is, the pair installation type refrigerator according to the implementation of the present disclosure may include the second refrigerator 200 that is distinguished from, but used together with, the first refrigerator 100 because of different usages. Or the second refrigerator 200 can be used independently with the first refrigerator 100 for increases of a storage capacity.

In some implementations, a pair installation type refrigerator according to an implementation of the present disclosure may include a cabinet 10 in which a storage space is formed inside a machine room 25. The machine room 25 is provided under the cabinet 10 and equipped with a compressor 21, a condenser 22, and a cooling fan constituting a freezing cycle. A discharge portion 115 is open on the side of the machine room 25 and discharges air inside the machine room. A flow guide 300 is mounted on the discharge portion 115 and open upward to guide air discharged from the discharge portion 115 to flow upward along a side of the cabinet.

In some implementations, the pair installation refrigerator according to the implementation of the present disclosure may include a decor member 500 extending in a vertical direction along a space (S1) between the first refrigerator 100 and the second refrigerator 200 and disposed in the space between the first refrigerator 100 and the second refrigerator 200 to shield the space (S1) between the first refrigerator 100 and the second refrigerator 200 from the front.

In some implementations, the machine room 25 that is a space independent from the storage space may be provided at the rear of a lower end of the cabinet. The machine room 25 may provide a space in which components such as a compressor 21 and a condenser 22 constituting a refreezing cycle may be arranged. In some implementations, outside air may be introduced into the machine room through discharge ports 115 and 215 formed on both left and right sides of the machine room 25 to cool the condenser 22 and the compressor 21 and then discharged to the outside. The machine room 25 may be independently provided in the first refrigerator 100 and the second refrigerator 200, individually. Here, a machine room provided in the first refrigerator 100 may be referred to as a first machine room, and a machine room provided in the second refrigerator 200 may be referred to as a second machine room.

In some implementations, in the first refrigerator 100, a flow guide 300 may be provided to guide air which is discharged to the discharge port 115 located on a side of the first cabinet 10 that is adjacent to the second refrigerator 200, so as to flow upward along the side of the first cabinet 10.

The flow guide 300 may serve to guide the discharged air toward the upper portion of the outer case 110. In detail, the flow guide 300 may shield a surface facing the discharge port 115 and has an opening only on the upper surface, to allow the air discharged from the discharge port 115 to flow to the upper portion of the first refrigerator 100, thus restricting dew condensation from occurring on the side of the outer case 110.

The first cabinet 10 and the second cabinet 20 are composed of a plurality of parts, and may largely include outer cases 110 and 210 defining an outer wall and inner cases 160 and 260 defining an inner wall.

The outer cases 110 and 210 are formed in a substantially hexahedral shape which is open to the front and rear sides and the lower side. In some implementations, the inner cases 160 and 260 are installed inside the outer cases 110 and 210 to be spaced apart from the outer cases 110 and 210, and a foam material may be filled in a space between the inner case and the outer case.

In detail, the first refrigerator 100 may form a storage chamber 101, and include a plate-shaped first outer case 110 defining an outer surface of the first cabinet 10, and first doors 120 and 130 which open and close the storage chamber 101.

Further, the second refrigerator 100 may form, for example, a storage chamber 201, and include a plate-shaped second outer case 210 defining an outer surface of the second cabinet 20, and second doors 220 and 230 which open and close the storage chamber 201.

The storage chambers provided in the first refrigerator 100 and the second refrigerator 200 may be configured in plural in each of the first and second refrigerators 100 and 200, and each storage chamber may be maintained at different storage temperatures. For example, as shown in FIGS. 1 and 2, an upper space of the first and second cabinets may be configured as a refrigerating chamber 101 and a lower space may be configured as a freezing chamber. Other implementations are possible.

The first and second doors may include first and second refrigerating chamber doors 120 and 220 that open and close the refrigerating chamber, and first and second freezing chamber doors 130 and 230 that open and close the freezing chamber.

In some implementations, the first and second refrigerating chamber doors 120 and 220 are hingedly coupled to the refrigerator bodies and thus may be configured to open and close the refrigerating chamber by rotation relative to the refrigerator bodies.

The first refrigerating chamber door 120 and the second refrigerating chamber door 220 may be configured to open and close by rotating in opposite directions to each other so that a user uses the refrigerating chamber doors without interfering with each other when simultaneously opening and closing the refrigerating chamber doors.

In detail, the first refrigerating chamber door 120 may be coupled to the first cabinet by a hinge 14 (FIG. 13) such that the door 120 is rotatable. In some implementations, the second refrigerating chamber door 220 may be coupled to the second cabinet 200 by a hinge 24 (FIG. 13) to be opened symmetrically to the opening direction of the first refrigerating chamber door 120.

That is, the refrigerator of the present disclosure may include a first hinge 14 connecting the first refrigerating chamber door 120 to the first cabinet 100 and a second hinge 24 connecting the second refrigerating chamber door 220 to the second cabinet 200. In some implementations, the first hinge 14 and the second hinge 24 are provided on one side of the first cabinet 100 and one side of the second cabinet 200, respectively such that the opening directions of the first refrigerating chamber door 120 and second refrigerating chamber door 220 are symmetrical to each other.

Further, the first and second freezing chamber doors 130 and 230 can be of a drawer type in which the doors 130 and 230 may be configured to be drawn in and out to open and close a freezing chamber. A freezing chamber door may be configured in plural.

In some implementations, a plurality of shelves 102 and 202 may be provided in the refrigerating chambers of the first refrigerator 100 and the second refrigerator 200 to divide the storage chambers 101 and 201. The shelves 102 and 202 may be formed to be drawn out forwardly from the inside of a body of the refrigerator to the front such that foods to be stored in the shelves 102 and 202 are more easily stored as necessary.

The refrigerator according to an implementation of the present disclosure may include a discharge portion through which air inside the machine room is discharged, and a flow guide 300 disposed in the discharge portion and opened upwardly to guide air discharged from the discharge portion along the side of the cabinet.

A certain gap may be formed between the first refrigerator 100 and the second refrigerator 200. Discharge portions 115 and 215 may be respectively formed in sides of the first and second refrigerators 200 to allow air in the machine room to be discharged to the outside. Here, the discharge portion 115 provided in the side of the first refrigerator 100 may be referred to as a first discharge portion, and the discharge portion 215 provided in the side of the second refrigerator 200 may be referred to as a second discharge portion.

When the first refrigerator 100 and the second refrigerator 200 are installed in close contact with each other without a certain gap, the air discharged through the discharge portions 115 and 215 may not flow to the outside and may be congested. Therefore, it is preferable that the first refrigerator 100 and the second refrigerator 200 are disposed at a certain distance such that the air inside the refrigerators can be smoothly discharged to the outside.

In detail, the machine room 25 that is a space independent from the storage space may be provided at the rear of a lower end of the cabinet. The machine room may provide a space in which components such as a compressor and a condenser constituting a refreezing cycle may be arranged. In some implementations, outside air may be introduced into the machine room through discharge portions 115 and 215 formed on both left and right sides of the machine room to cool the condenser and the compressor and then discharged to the outside.

In some implementations, the first refrigerator 100 may include a flow guide 300 to guide air discharged to the discharge portion 115 located on the side adjacent to the second refrigerator 200 among both sides of the first cabinet 10 so as to flow upward along the side of the cabinet. The flow guide 300 may serve to guide the discharged air toward the upper portion of the outer case 110.

In detail, the flow guide 300 may shield a surface facing the discharge portion 115 and has an opening only on the upper surface, to allow the air discharged from the discharge portion 115 to flow to the upper portion of the first refrigerator 100, thus preventing condensation from occurring on the side of the outer case 110.

The flow guide 300 according to the present disclosure is provided in the outer surface 113*a* of the side portion 113 of the outer case 110 of the first refrigerator to allow air discharged from the machine room through the discharge portion 115 to be charged to an upper portion of the outer case 110, thus restricting dew condensation phenomenon.

In some implementations, a forming portion 116 provided to protrude to reinforce the outer case 110 may be provided at a lower end the rear of the outer case 110.

A plurality of forming portions 116 may be provided, and may be continuously disposed in a predetermined direction along the surface of the outer case 110.

The machine room 25 that is a space independent from the storage space may be provided at the rear of a lower end of the cabinet 10. The machine room 25 may provide a space in which components such as a compressor 21 and a condenser 22 constituting a refreezing cycle may be arranged. In some implementations, outside air may be introduced into the machine room 25 through an opening formed on both left and right sides of the machine room 25 to cool the condenser 22 and the compressor 21 and then discharged to the outside.

As shown in the drawing, the machine room 25 may be open at the lower end of the rear surface of the cabinet 10 and a plurality of components including a compressor 21, a condenser 22, and a cooling fan 23 are disposed therein. The machine room 25 may be shielded by a machine room cover 55.

The compressor 21 and the condenser 22 constituting a refreezing cycle are provided at both sides of the inside of the machine room 25, and a cooling fan 23 may be provided between the compressor 21 and the condenser 22. In some implementations, a drain tube 222 for discharging defrost water generated from a evaporator and a drain pan 221 for collecting defrost water may be provided inside the machine room 25, and a dryer connected to a refrigerant pipe (P), an expansion device, and the like may be provided in the machine room 25.

Cover suction ports 55*a* and cover discharge parts 55*b* may be formed in both left and right sides of the machine room cover 55, respectively, and the cover suction ports 55*a* and the cover discharge parts 55*b* may be disposed at positions corresponding to the positions of the condenser 22 and the compressor 21.

Therefore, when the cooling fan 23 is driven, outside air introduced through the cover suction ports 55*a* cools the condenser 22 while passing through the condenser 22, and is blown toward the compressor 21 by the cooling fan 23 to cool the compressor 21 and then discharged to the outside through the cover discharge portion 55*b*.

Meanwhile, the discharge portion 115 may be provided on both sides of the outer case 110 corresponding to both left and right sides of the machine room 25. The discharge portion on one side corresponding to the condenser 22 may guide outside air to be introduced into the machine room 25, and the discharge portion 115 on the side corresponding to the compressor 21 may guide air in the machine room 25 to be discharged to the outside.

Of course, the cover suction port 55*a* and the cover discharge portion 55*b* of the machine room cover 55 may be provided together with the discharge portion 15, and if necessary, only one of the cover suction port 55*a* and the cover discharge portion 55*b* may be provided.

In some implementations, the flow guide 300 is connected to the discharge portion 115 disposed at the lower portion of one side of the outer case 110 to guide air discharged from the machine room through the discharge portion 115 to flow to the upper portion of the outer case 110.

Hereinafter, a structure of the flow guide 300 will be described in more detail with reference to the drawings.

Figure 5:
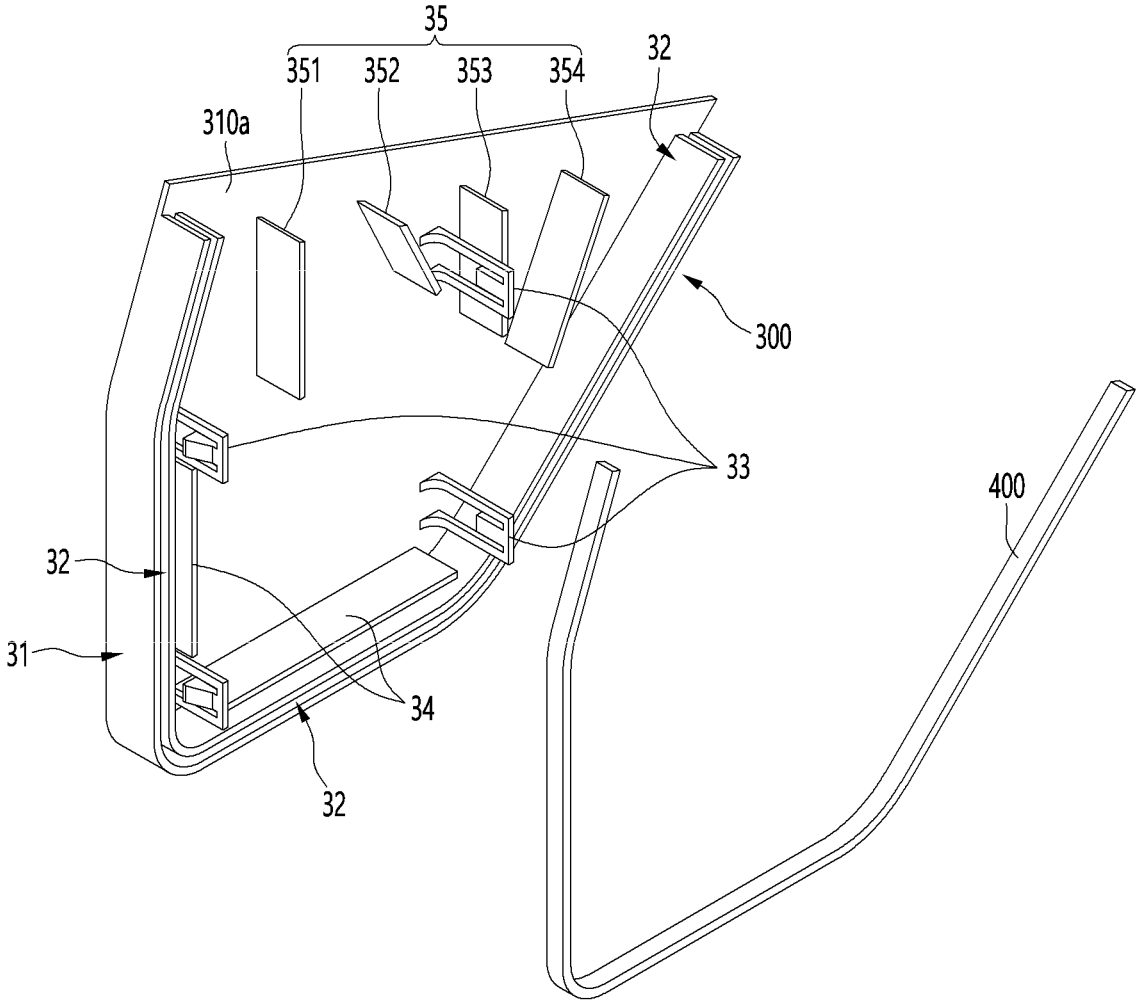
FIG. 5 is a perspective view showing an example flow guide.
Figure 6:
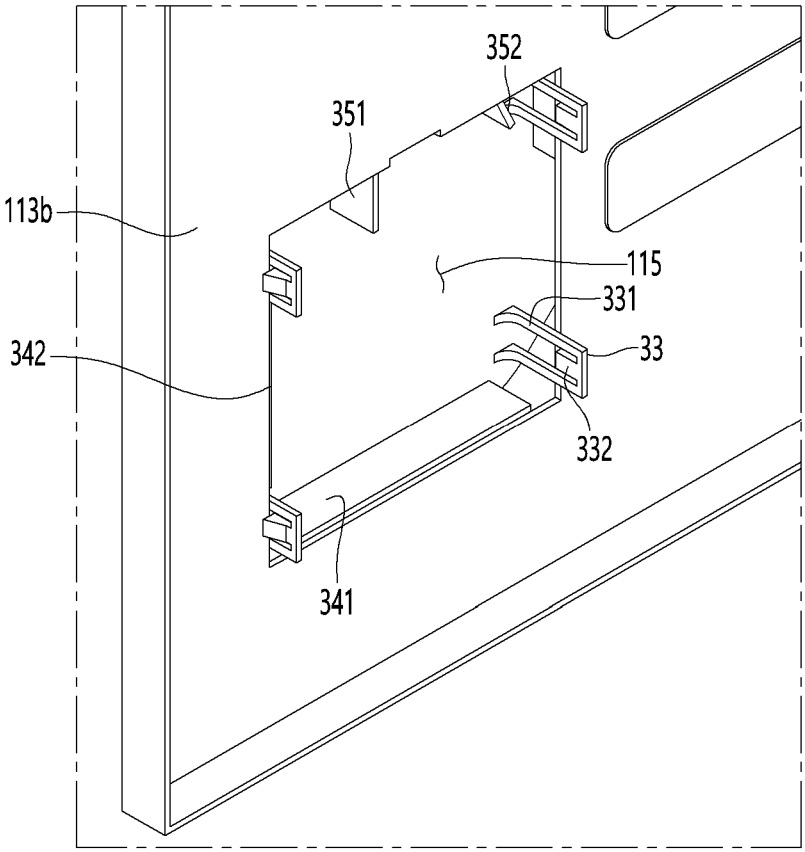
FIG. 6 is a partial cross-sectional view showing an example assembly state of the flow guide and a discharge portion.
Figure 7:
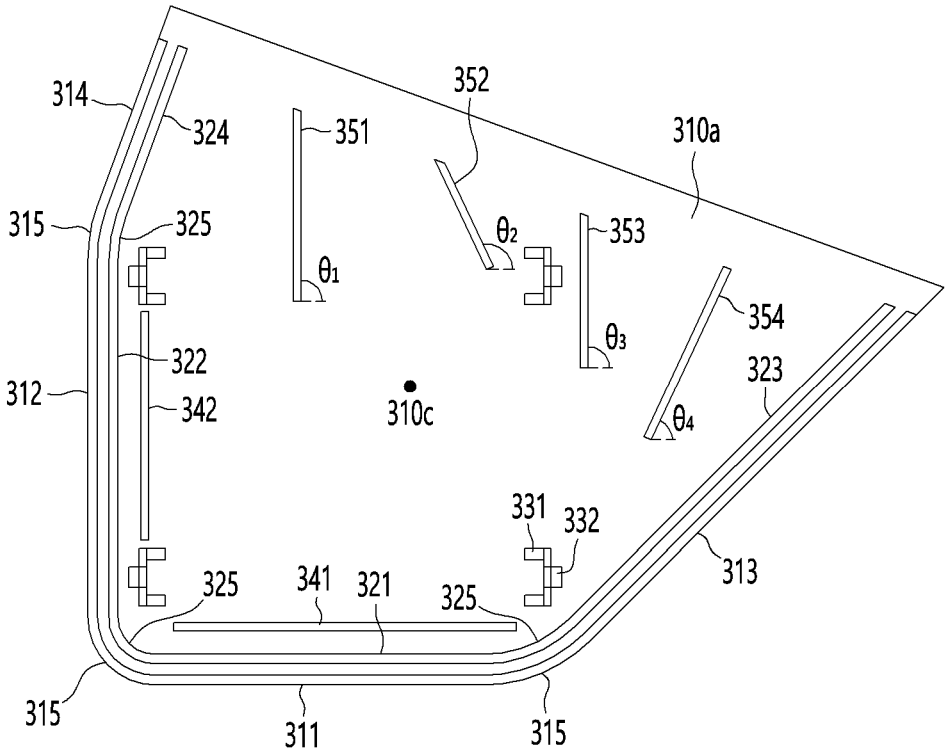
FIG. 7 is a cross-sectional view showing an inner surface of the flow guide as viewed from the discharge portion.

FIG. 5 is a perspective view showing the flow guide. FIG. 6 is a partial cross-sectional view showing the assembly state of the flow guide and the discharge portion. Further, FIG. 7 is a cross-sectional view showing the inner surface of the flow guide as viewed from the discharge portion.

The flow guide 300 may face the guide body 31 forming edges of the flow guide 300 and the discharge portion 115, and include a guide inner surface 310*a* that guide air discharged from the discharge portion 115 to flow toward the upper portion of the outer case 110.

The guide body 31 may include a first edge portion 311 forming a bottom of the flow guide, and a second edge portion 312 and a third edge portion 313 extending upward from the first edge portion 311 at both sides of the flow guide to form sides thereof.

In detail, the guide body 31 may include the first edge portion 311 forming a bottom of the flow guide 300, the second edge portion 312 extending upward from the first edge portion 311 to form one side of the guide body 31, and the third edge portion 313 extending upward from the first edge portion to form the other side of the guide body 31.

For example, one side and the other side of the guide body 31 may form side surfaces facing each other.

The second edge portion 312 and the third edge portion 313 may be formed to be perpendicular to or inclined relative to the first edge portion 311.

In some implementations, the guide body 31 may further include a fourth edge portion 314 extending from the second edge 312 and bent (angled) from the second edge 312.

Specifically, the first edge portion 311 may be formed parallel to the lower end of a side of the outer case 110, and the second edge portion 312 may be formed to extend upward from the first edge portion to be perpendicular to the first edge portion 311 or inclined toward the front 112 of the outer case. The third edge portion 313 may be formed to be inclined upward toward the front 112 of the outer case 112.

In some implementations, the fourth edge portion 314 may be formed parallel to the third edge portion 313 or at different inclination from that of the third edge portion 313.

In detail, the guide body 31 may further include a fourth edge portion 314 extending from the second edge portion 312 and inclined toward the center direction 310*c* of the guide inner surface 310*a*.

In some implementations, the fourth edge portion 314 may be formed such that an angle between the first edge portion 311 and the fourth edge portion 314 is greater than an angle between the first edge portion 311 and the third edge portion 313.

Portions in which the first and second edge portions 311 and 312 are connected, the second and third edge portions 312 and 313 are connected, and the first and fourth edge portions 311 and 314 are connected may further include a connection edge portion 315 rounded with a predetermined curvature.

The guide inner surface 310*a* may be formed along an edge portion of the guide body 31 and may extend upward by a predetermined width. That is, the guide inner surface 310*a* may protrude from the upper end of the guide body 31.

The flow guide 300 may further include a sealing frame 32 protruding from the guide inner surface 310*a* and spaced apart from the edge portions of the guide body 31 in the center direction 310*c* of the guide inner surface.

In some implementations, a sealing member may be included between the edge portions of the guide body 31 and the sealing frame 32.

Specifically, the sealing frame 32 may include a first frame portion 321 spaced apart from and parallel to the first edge portion 311, a second frame portion 322 spaced apart from and parallel to the second edge portion 312 and a third frame portion 323 spaced apart from and parallel to the third edge portion 313.

The sealing frame 32 may further include a fourth frame portion 324 spaced apart from and parallel to the fourth edge portion 314 of the guide body.

In some implementations, portions in which the first and second frame portions 321 and 322 are connected, the second and third frame portions 322 and 323 are connected, and the first and fourth frame portions 321 and 324 are connected may further include a connection frame portion 325 rounded with a predetermined curvature.

In an implementation according to the present disclosure, as shown in FIG. 5, a sealing member 400 may be further included between the edge portions of the guide body 31 and the sealing frame 32.

A gap between the guide body 31 and the sealing frame 32 may be airtight by the sealing member 400, and through this, the air discharged from the discharge portion 115 may be guided to be discharged only in the upper direction of the guide body 31. In some implementations, the sealing member 400 may allow the flow guide 300 to be bonded to the side of the outer case 110.

The flow guide 300 may include a restraining mechanism 33 protruding from the guide inner surface 310*a* and provided in plural according to the edge of the discharge portion 115 to couple the flow guide 300 and the discharge portion 115.

The restraining mechanism 33 is coupled to the discharge portion 115 to prevent the flow guide 300 from being separated from the outer case 110, and is installed along the edge of the discharge portion 115 to completely cover the discharge portion 115 not to be seen from the outside.

The restraining mechanism 33 can include a mechanism capable of being coupled with the discharge portion 115 such as a hook or screw may be used.

As shown in FIGS. 5 and 6, the restraining mechanism 33 according to an implementation of the present disclosure may include a hook body 331 formed integrally with the guide inner surface 310*a* and a fastening hook 332 protruding in the direction of the inner portion 113*b* of the outer case such that the restraining mechanism 33 is not separated from the discharge portion 115 when is being inserted to the discharge portion 115.

Referring to FIG. 6, the hook body 331 has a 'C' shape as a whole, and may be composed of a fastening hook 332 protruding from the hook body 331 in the direction of the guide inner surface 310*a*, the fastening hook 332 being fastened.

The restraining mechanism 33 may be formed to be elastically deformable to facilitate coupling with the discharge part 115.

The flow guide 300 according to the present disclosure may further include an insertion guide 34 protruding to the guide inner surface 310*a* and contacting an end of the discharge portion 115 to allow the flow guide 300 to be inserted to the discharge portion 115.

When coupling the flow guide 300 to the discharge portion 115, the restraining mechanism 33 is inserted into the discharge portion 115. Since the restraining mechanism 33 is relatively smaller than the size of the flow guide 300, the restraining mechanism 33 may be damaged due to incorrect assembly by an operator. In particular, the fastening hook 332 may be relatively weak to break, and thus the connection portion between the hook body 331 and the fastening hook 332 may be easily damaged.

In some implementations, since the flow guide 300 is coupled to the discharge portion 115 by the fastening hook 332, when the fastening hook 332 is damaged, the flow guide 300 may not be assembled at the correct position, so that it may be difficult to guide flow of air discharged from the machine room in a desired direction.

In the present disclosure, the insertion guide 34 is provided, so that when the operator inserts the flow guide 300 into the discharge portion 115, the insertion guide 34 is correspondingly arranged and inserted at the positions of the lower end and the side end of the discharge portion 115, thus preventing incorrect assembly of the flow guide 300 and damage to the restraining mechanism 33 accordingly.

The insertion guide 34 may include, for example, a first insertion guide 341 spaced apart from and parallel to the first edge portion 311 and disposed at a lower end of the discharge portion 115 and a second insertion guide 342 spaced apart from and parallel to the second edge portion 312 and disposed at one side end of the discharge portion 115.

The length of the first insertion guide 341 may be formed to be shorter than the length of the lower end of the discharge portion 115, and the length of the second insertion guide 342 is formed to be shorter than the length of the side end of the discharge portion 115. The length of the insertion guide 34 may be formed to be shorter than a distance between the restraining mechanisms 33 positioned on both sides of the insertion guide 34.

The flow guide 300 may include a guide rib 35 protruding from the guide inner surface 310*a* and extending in a direction crossing the first edge portion 311 of the guide body.

That is, the guide rib 35 may be disposed to be perpendicular to or inclined relative to the first edge portion 311.

The guide rib 35 may have a plurality of guide ribs 35 having the same length or different lengths to guide the flow of air discharged to the discharge portion 115 so that the upper end of the guide rib 35 may be positioned in an upper portion of the guide inner surface 310*a*.

The guide rib 35 may obliquely extend from the lower end thereof toward the upper side of the front of the refrigerator so as to guide air discharged from the machine room to the discharge portion 115 to flow toward or the front or the center of the upper portion of a side of the outer case 110.

Specifically, the first to fourth guide ribs are formed to cross the first edge portion.

As an example, the guide rib 35 may include a first guide rib 351 of which an angle θ1 with the first edge portion 311 is formed to be perpendicular or inclined and a second guide rib 352 of which an angle θ2 with the first edge portion 311 is an obtuse angle.

In some implementations, the guide rib 35 may include a third guide rib 353 of which an angle θ3 with the first edge portion 311 is formed to be perpendicular or inclined and a fourth guide rib 354 of which an angle θ4 with the first edge portion 311 is an obtuse angle.

In some implementations, the first guide rib 351, the second guide rib 352, the third guide rib 353 and the fourth guide rib 354 of the guide rib 35 may be arranged in a direction from the second edge portion 312 toward the third edge portion 313.

In some implementations, a lower end of the guide rib 35 may be disposed below an upper end of the discharge portion 115.

Specifically, the first guide rib 351 may extend from a position that corresponds to an upper portion of the second edge portion 312, toward an upper end of the guide body 31. When the flow guide 300 is inserted into the discharge portion 115, the lower end of the first guide rib 351 is arranged above the discharge portion 115, and the upper end of the first guide rib 351 is arranged to protrude to the upper end of the discharge portion 115.

The second guide rib 352 may extend from a position that corresponds to the upper portion of the second edge portion 312, toward the upper end of the guide body 31. When the flow guide 300 is inserted into the discharge portion 115, the lower end of the second guide rib 352 is arranged above the discharge portion 115, and the upper end of the second guide rib 352 is arranged to protrude to the upper end of the discharge portion 115.

In some implementations, the lower end of the second guide rib 352 may be positioned above the lower end of the first guide rib 351.

In some implementations, the lower ends of the third and fourth guide ribs 353 and 354 may be disposed in the outer upper portion of the discharge portion Specifically, the third guide rib 353 may extend from a position that corresponds to an upper portion of the second edge portion 312, toward an upper end of the guide body 31. When the flow guide 300 is inserted into the discharge portion 115, the third guide rib 353 may be arranged in the outer upper portion of the discharge portion 115.

In some implementations, the lower end of the third guide rib 353 may be positioned below the lower end of the first guide rib 351.

The fourth guide rib 354 may extend from a position that corresponds to an upper portion of the second edge portion 312, toward an upper end of the guide body 31. When the flow guide 300 is inserted into the discharge portion 115, the fourth guide rib 354 may be arranged in the outer upper portion of the discharge portion 115.

In some implementations, a lower end of the fourth guide rib 354 may be positioned below a lower end of the first guide rib 351 or the third guide rib 353.

The upper end of the guide rib 35 may be arranged along an upper end of the guide inner surface 310*a*. When the upper end of the guide inner surface 310*a* is formed to be inclined, the upper end of the guide rib 35 may be arranged along the inclination of the upper end of the guide inner surface 310*a*.

Figure 8:
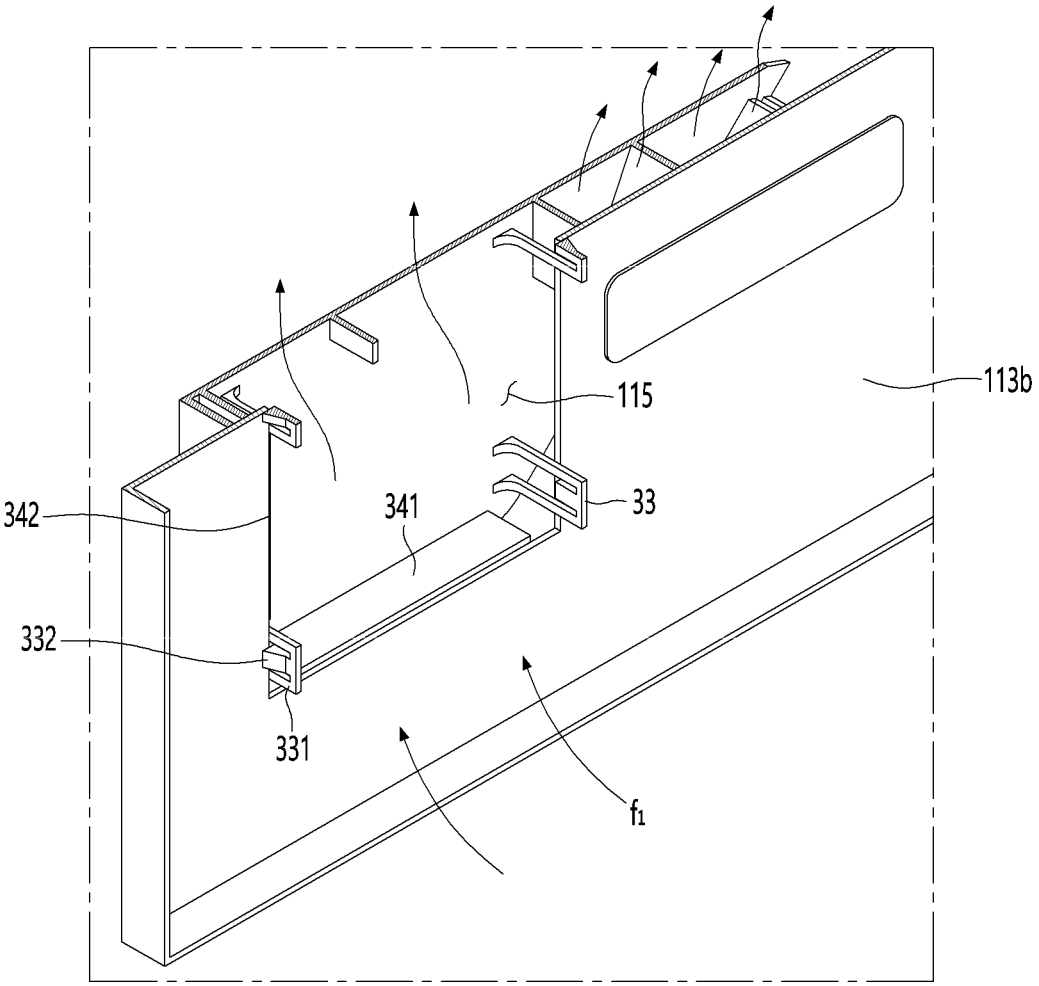
FIG. 8 is a perspective view of a coupling structure of the flow guide and the discharge portion as viewed from another side.
Figure 9:
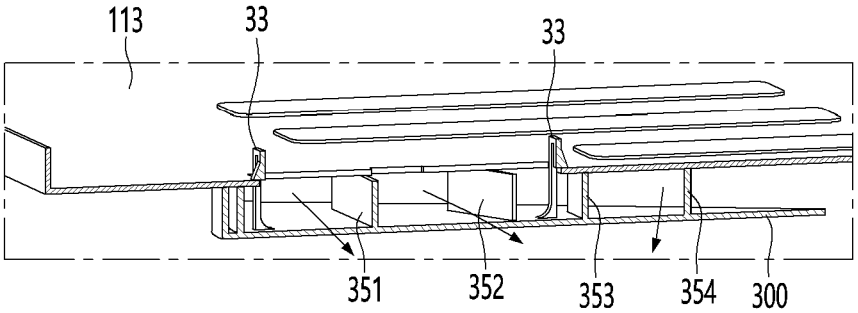
FIG. 9 is a perspective view of a coupling structure of the flow guide and the discharge portion as viewed from another side.

FIG. 8 is a perspective view of a coupling structure of the flow guide and the discharge portion as viewed from another side. FIG. 9 is a perspective view of a coupling structure of the flow guide and the discharge portion as viewed from another side.

As shown in FIGS. 8 and 9, air (f1) discharged from the machine room through the discharge portion 115 is guided to be discharged toward the upper portion of the outer case 110 to raise a dew point in the side of the outer case 110 due to a heat source of the air, thus restricting dew condensation phenomenon.

In detail, one side of a body of the flow guide 300 is formed along one side end of the discharge portion 115 to restrict the air (f1) discharged from the machine room from flowing to the rear of the outer case 110. In some implementations, the bottom of the body of the flow guide 300 is formed along the lower end of the discharge portion 115 to restrict the air (f1) from flowing to the lower side of the outer case 110.

In some implementations, the other side of the body of the flow guide 300 may be formed to be inclined toward the front of the outer case 110. The top of the body of the flow guide 300 may define a space through which air can be discharged to allow the air to be discharged toward the upper side of the outer case 110.

In some implementations, the guide rib 35 may allow flow of the air to be guided upward of the outer case 110.

In detail, the first guide rib 351 and the second guide rib 352 are arranged at positions facing the inner surface of the discharge portion 115 to guide the air discharged from the discharge portion 115 to be discharged to the upper side of the outer case 110.

In some implementations, the third guide rib 353 and the fourth guide rib 354 are arranged in an upper portion of the outer side of the discharge portion 115 to guide the air to be discharged toward the upper center of the outer case 110.

The refrigerator of the present disclosure may further include a side grill 400 between the flow guide 300 and the discharge portion 115.

Figure 10:
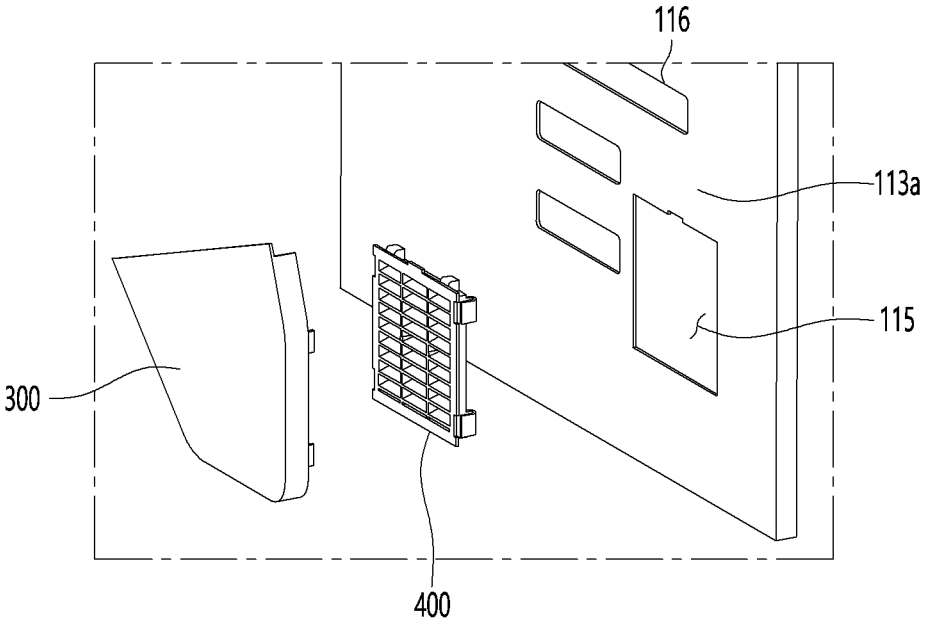
FIG. 10 is an exploded perspective view showing a coupling structure of the flow guide, a guide grill, and the discharge portion.
Figure 11:
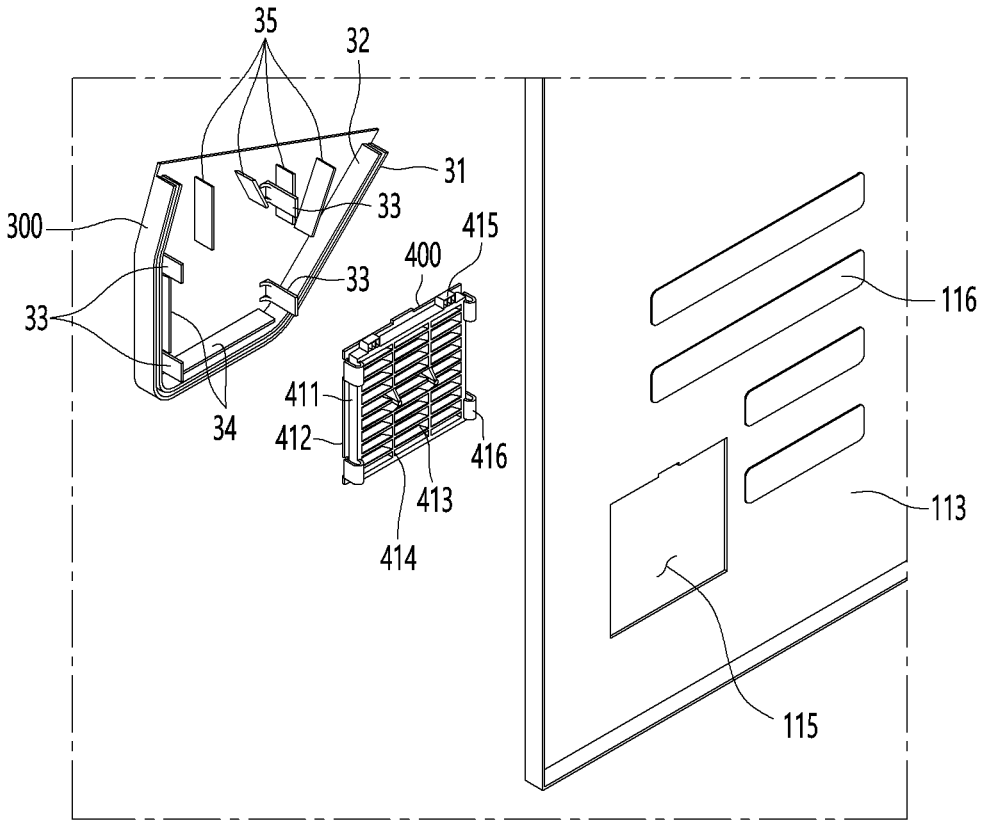
FIG. 11 is an exploded perspective view showing the coupling structure of the flow guide, the guide grill, and the discharge portion as viewed from another side.
Figure 12:
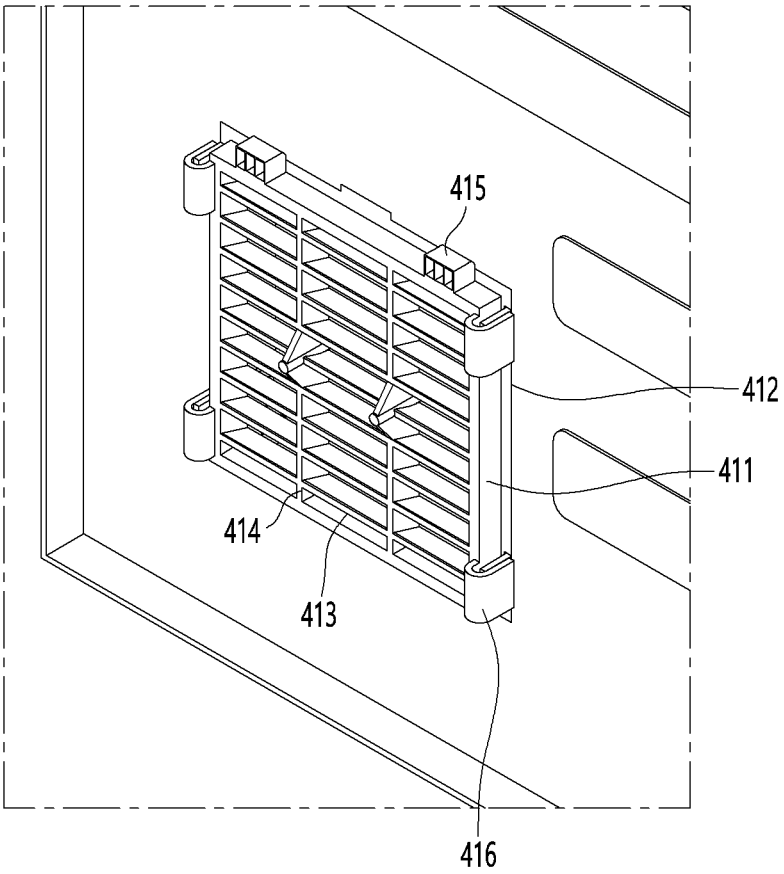
FIG. 12 is a partial perspective view showing a state in which the flow guide and the guide grill are mounted on the discharge portion.

FIG. 10 is an exploded perspective view showing a coupling structure of the flow guide, the guide grill, and the discharge portion. Further, FIG. 11 is an exploded perspective view showing a coupling structure of the flow guide, the guide grill, and the discharge portion as viewed from another side. FIG. 12 is a partial perspective view showing a state in which the flow guide and the guide grill are mounted on the discharge portion.

Referring to FIGS. 10 to 12, the side grill 400 may be formed in a corresponding shape so as to cover the discharge portion 115. For example, the side grill 400 may be formed in a rectangular shape and may be formed to be the same as or slightly larger than the size of the discharge portion 115.

The side grill 400 may include a grill body 411 having an opening, and a plurality of horizontal ribs 413 and vertical ribs 414 intersecting each other at predetermined distances may be provided in the opening.

Specifically, the side grill 400 may generally include a grill body 411 and a grill edge 412. The grill body 411 may define openings through which air flows. The opening of the grill body 411 has a plurality of horizontal ribs 413 and vertical ribs 414 arranged to intersect each other at regular intervals, and air may enter and exit through air flow paths formed between the horizontal ribs 413 and the vertical ribs 414. The horizontal ribs 413 and the vertical ribs 414 may have an inclination to allow air discharged from the machine room to have directionality.

The grill edge 412 may be formed along an end of the grill body 411 and may extend outward by a predetermined width. The grill body 411 may be formed to be slightly smaller than the size of the discharge portion 115, and the grill edge 412 may be formed to be larger than the size of the discharge portion 115. Accordingly, the grill body 411 may form an air flow path inside the discharge portion 115, and the grill edge 412 may contact the outer surface of the outer case 110 to enable the side grill 400 to be installed.

Further, a grill restraining portion 415 may protrude from the upper and lower surfaces of the grill body 411. If necessary, the grill restraining portion 415 may be formed on both left and right sides of the grill body 411, and a plurality of grill restraining portions 415 may be spaced apart from each other in each of the sides.

An inclined surface may be formed on the outer surface of the grill restraining portion 415, and when the side grill 400 is inserted into the discharge portion 115, the side grill 400 is in contact with the end of the discharge portion 115 to guide insertion of the side grill 400. The grill restraining portion 415 may be formed to be elastically deformable to facilitate mounting of the side grill 400.

In some implementations, a grill mounting portion 416 capable of enabling coupling with the flow guide 300 may be formed to protrude from the outer surface of the grill body 411.

Accordingly, air discharged from the machine room to the discharge portion 115 is discharged to the upper surface of the flow guide 300 after passing through the side grill 400, thereby changing the flow of air in the upper direction of the outer case 110.

The flow guide 300 is provided on the side of the outer case of the refrigerator to guide air discharged from the machine room through the discharge portion toward the upper portion of the outer case. Accordingly, there is an advantage of restricting the dew condensation phenomenon by increasing a dew point at the side of the outer case by using a heat source of the air.

In addition, the techniques described herein provide more economical and simplified solutions for restricting dew formation phenomenon than conventional methods that use additional parts such as a heater, a condenser and the like to reduce dew condensation phenomenon.

In particular, the techniques described herein can restrict the dew condensation phenomenon occurring on the side of the refrigerator when refrigerators are arranged in parallel at regular intervals or installed close to a wall surface.

Hereinafter, the decor member 500 constituting an implementation of the present disclosure will be described in detail.

Figure 13:
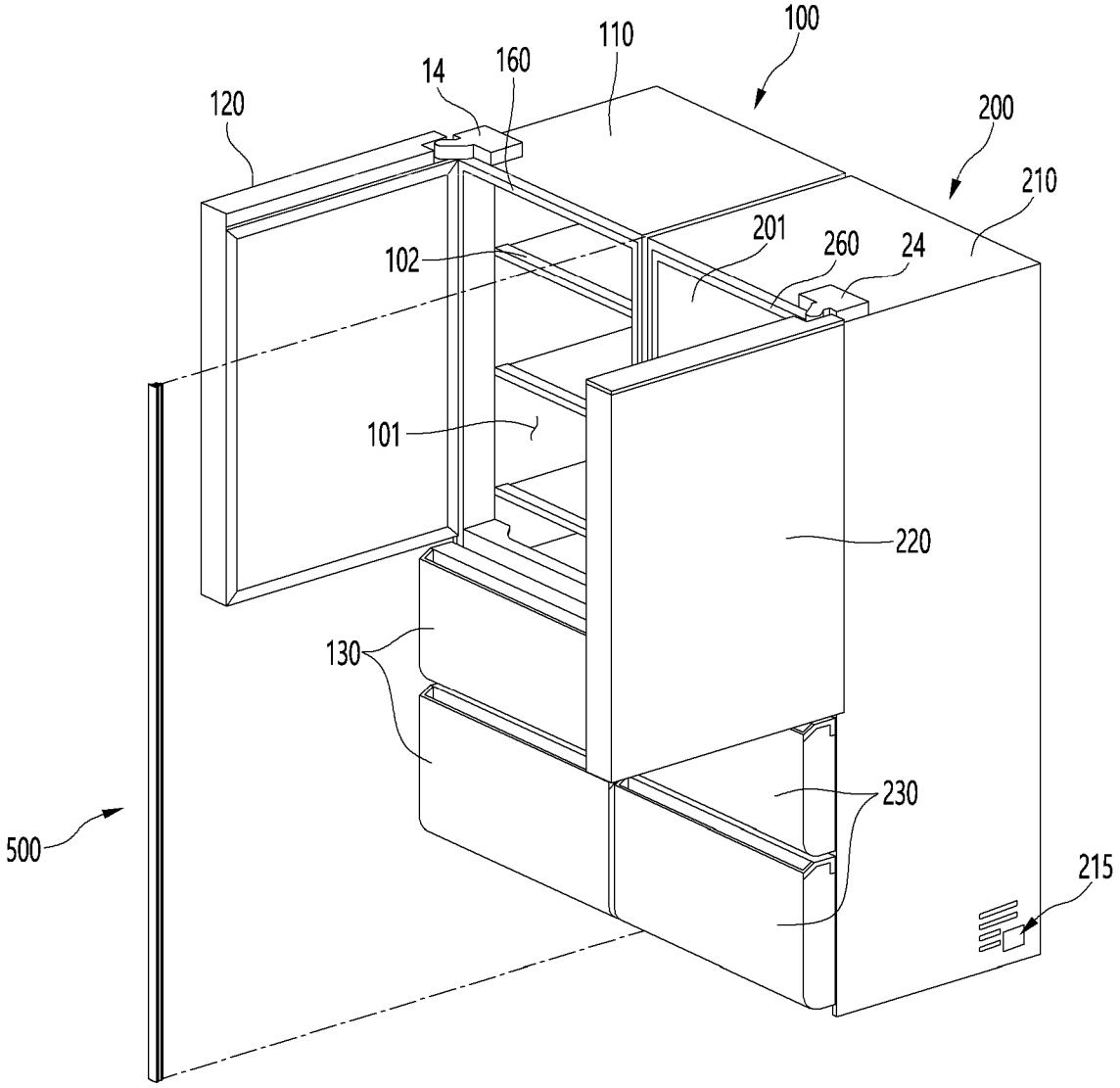
FIG. 13 is a perspective view showing a state in which a refrigerator and a decor member are separated from each other according to an implementation of the present disclosure.
Figure 14:
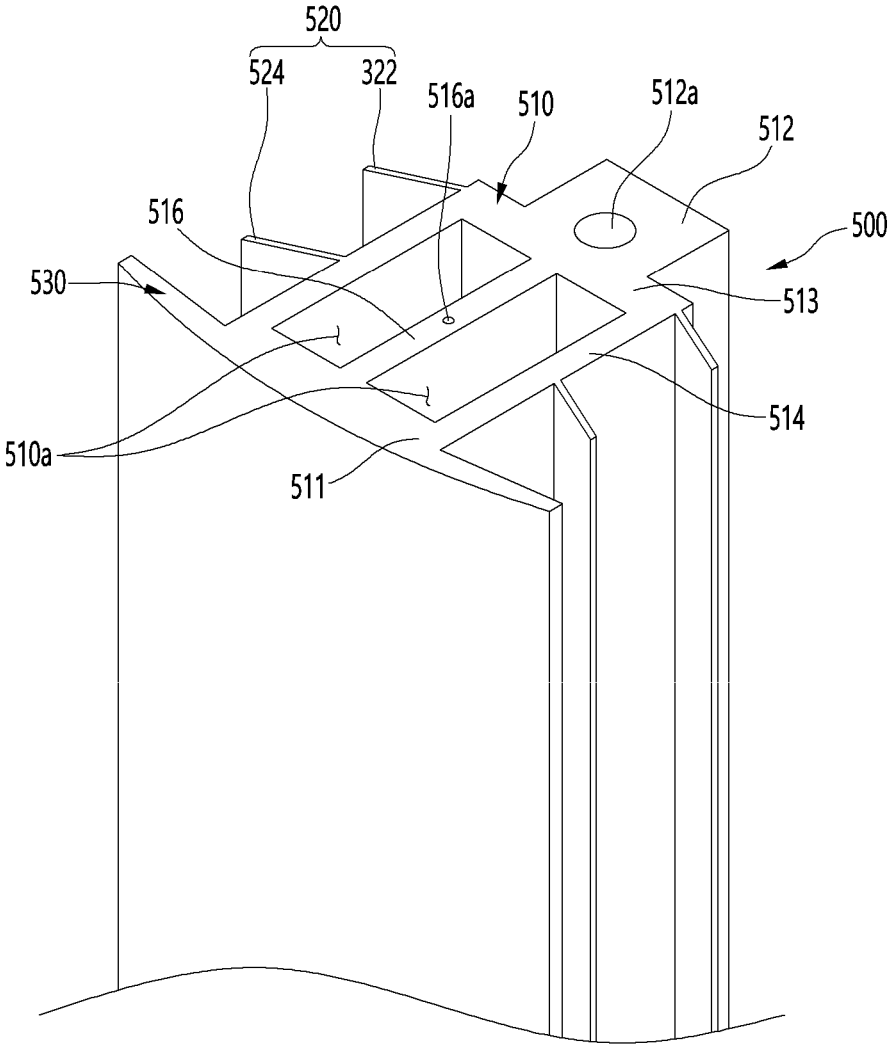
FIG. 14 is a perspective view showing the decor member as viewed from above.
Figure 15:
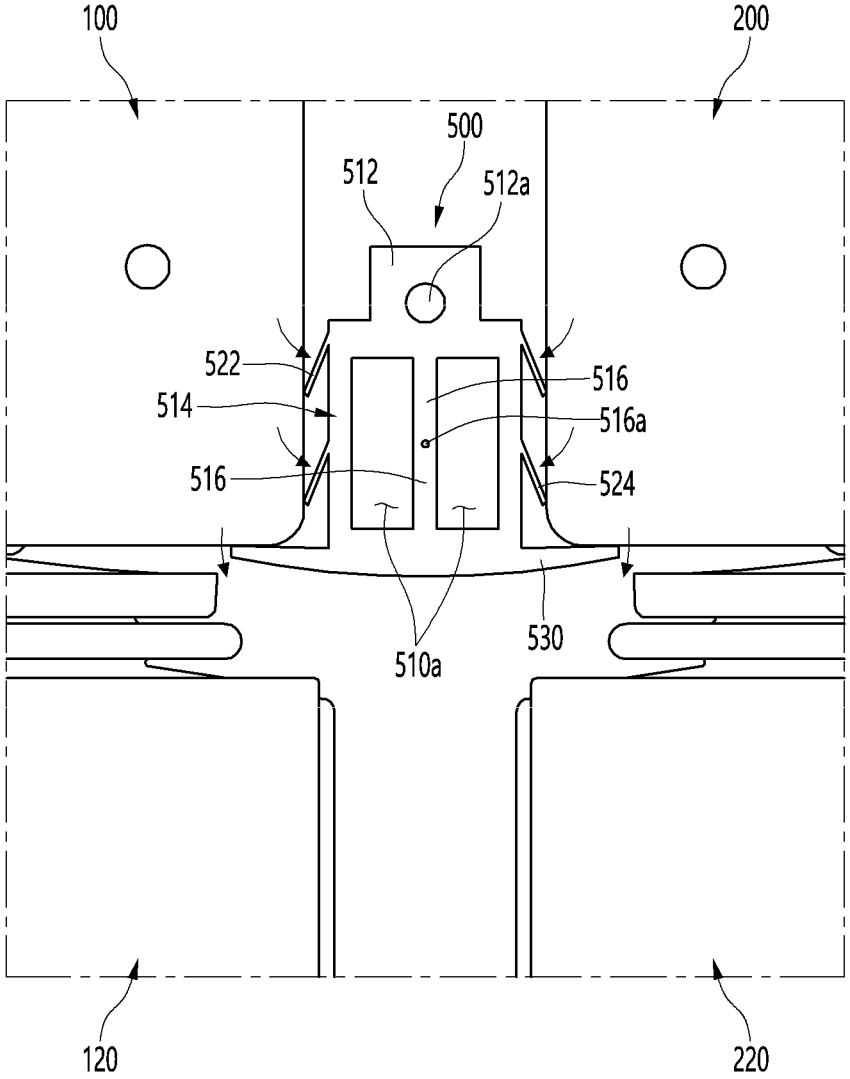
FIG. 15 is a plan view showing a state in which the decor member is mounted on the refrigerator as viewed from above.

FIG. 13 is a perspective view showing a state in which a refrigerator and a decor member are separated from each other according to an implementation of the present disclosure. Further, FIG. 14 is a perspective view showing a state a decor member constituting an implementation of the present disclosure as viewed from above. Further, FIG. 15 is a plan view showing a state in which the decor member is mounted on the refrigerator as viewed from above.

The refrigerator according to an implementation of the present disclosure may include a decor member 500 provided between the first refrigerator 100 and the second refrigerator 200 to shield a space S1 between the first refrigerator 100 and the second refrigerator 200 (hereinafter, referred to as a space (S1) between refrigerators).

The first refrigerator 100 and the second refrigerator 200 may include discharge ports 115 and 215 formed on a side of the cabinet to discharge air inside the machine room 25 provided with a compressor and a condenser to the outside.

The decor member 500 may include an insertion portion 510 disposed between the first cabinet 10 and the second cabinet 20, and a shielding portion 530 protruding from the front end of the decor member 500 to both sides and supported on a front surface of the first cabinet and a front surface of the second cabinet.

The decor member 500 may include the insertion portion 510 including a through portion 510*a* passing through the top and bottom, and a side rib 520 formed to protrude from both sides of the insertion portion 510 to the outside (a direction away from the insertion portion 510).

The insertion portion 510 may have a rectangular shape and may be formed to elongate along one side of the outer case. That is, the insertion portion 510 may be formed to extend in a perpendicular direction with respect to the lower end of the first outer case 110.

In detail, the decor member 500 may include the insertion portion 510 extending along a space S1 between the front surface of the first refrigerator 100 and the front surface of the second refrigerator 200 disposed on both sides and hollow inside and a side rib 520 formed to protrude from both sides of the insertion portion 510 in a direction far away the insertion portion 510. Further, the decor member 500 may include the shielding portion 530 extending from the front surface of the insertion portion 510 to both sides, and formed in a convexly rounded shape toward the front of the insertion portion 510. The shielding portion 530 is supported on the front surfaces of the first refrigerator 100 and the second refrigerator 200 to shield the space S1 between the front surfaces of the first refrigerator 100 and the second refrigerator 200.

The insertion portion 510 may include the through portion 510*a*, reducing an overall weight of the decor member 500 and minimizing damage to the decor member 500 during transport and installation. In detail, since the decor member 500 has a vertical length equal to the height of the refrigerator with respect to the bottom of the refrigerator body, the decor member 500 may be easily damaged during transport and installation. In implementations of the present disclosure, the through part 510*a* is formed so that when an external force acts on the decor member 500, the through part 510*a* allows the external force to flow flexibly and be buffered.

The insertion portion 510 may include a front portion 511 forming a front surface of the insertion portion 510 and a side portion 514 extending rearward from the front portion 511 to form both sides of the insertion portion 510. In some implementations, a rear portion 513 connected to the side portion 514 to form a rear surface of the insertion portion 510 may be included and the through portion 510*a* formed to pass through from the top to the bottom of the insertion portion 510 may be included. That is, the insertion portion 510 may have the shape of a square frame through which the center is penetrated.

In some implementations, the insertion portion 510 may further include a central portion 516 extending rearward from the center of the front portion 511 of the insertion portion 510 and connected to the center of the rear portion 513 of the insertion portion 510. That is, the insertion portion 510*a* may be formed with a pair of through portions 510*a* by the central portion 516.

A magnetic fixing member may be inserted into each of the pair of through portions 510*a*. That is, the decor member 500 may be more firmly mounted on the sides of the first refrigerator 100 and the second refrigerator 200 by inserting magnetic fixing members into the pair of through portions 510*a*. The magnetic fixing member may be, for example, a magnet.

In some implementations, the central portion 516 may further include a support hole 516*a* formed to pass through from the top to the bottom at a center. A support wire made of a metal material may be inserted through the support hole 516*a*. The vertical length of the decor member 500 is formed to have a length corresponding to the height of the refrigerator, and the decor member 500 formed of a flexible plastic material may be bent by an external force or its own weight. In order to prevent such bending and improve durability of the decor member 500, the support wire may be inserted into the support hole 516*a*. The support wire may be, for example, a copper wire, but is not limited thereto.

The decor member 500 may include side ribs 520 formed on both sides of the insertion portion 510 and protruding from both sides of the insertion portion 510 to the outside (a direction away from the insertion portion 510). The side ribs 520 may serve to allow the decor member 500 to more firmly contact the sides of the first refrigerator 100 and the second refrigerator 200.

A plurality of side ribs 520 may be formed at the rear end and the center of the insertion portion 510.

For example, the side ribs 520 may include side ribs 522 extending from the rear ends of the side portions 514 of the insertion portions 510 in the directions of the side portions 514 of the first refrigerator 100 and the second refrigerator 200.

In some implementations, the side ribs 520 may include central ribs 524 extending from the centers of the side portions 514 of the insertion portions 510 in the directions of the side portions 514 of the first refrigerator 100 and the second refrigerator 200.

In some implementations, the side rib 520 may have an inclination to be closer to the front as it goes toward both ends of the side rib 520. That is, the side rib 520 may extend in a direction to be closer to the front surface of the insertion portion 510 as it goes toward both ends.

Due to the inclined structure, when the decor member 500 is inserted into the space S1 between refrigerators, the decor member 500 is folded (or flexed) in the same direction in which the side rib 520 is inserted, so that the operator may facilitate insertion of side rib 520.

The side rib 520 may be in contact with a front end of one side of the first refrigerator 100 and a front end of one side of the second refrigerator 200.

The decor member 500 may include the shielding portion 530 connected to the front portion 511 of the insertion portion 510 and extending toward both sides of the insertion portion 510.

The shielding portion 530 serves to shield the space S1 between the refrigerators from the front by connecting one side of the front surface of the body of the first refrigerator 100 and one side of the front surface of the body of the second refrigerator 200.

The center of the shielding portion 530 may be formed convexly toward the front of the insertion portion 510. In some implementations, both sides of the shielding portion 530 may have a structure inclined rearward as they go to the outside (a direction away from the insertion portion 510). That is, the shielding portion 530 may have a shape rounded convexly toward the front of the refrigerator body. This structure can improve a sense of continuity or uniformness on the front of the refrigerator body when the decor member 500 is inserted into the space S1 between refrigerators. In a case where the shielding portion 530 is formed to be convex to the rear of the insertion portion 510, when the decor member 500 is inserted into the space S1 between the refrigerators, the user's sense of discontinuity or non-uniformness may result since the shielding portion 530 has a rounded shape from the front to the rear.

In some implementations, both sides of the shielding portion 530 may be formed to extend further outward (in a direction away from the insertion portion 510) than the side portion 514 of the insertion portion 510. In some implementations, both side ends of the shielding portion 530 may extend more outward than both side ends of the side rib 520. This is for the shielding portion 530 to completely shield the space S1 between the refrigerators from the front, and to maximize an area mounted on the first refrigerator 100 and the second refrigerator 200. In some implementations, it is to prevent the decor member 500 from being excessively inserted into the space S1 between the refrigerators.

The decor member 500 may further include a rear decor 512 protruding rearward from the rear portion 513 of the insertion portion 510. A connection hole 512*a* connected to the upper bracket 700 to be described later is formed in the center of the rear decor 512.

In detail, the rear decor 512 extends rearward from the central portion 516 of the insertion portion 510, and the horizontal length of the rear decor 512 is formed shorter than the horizontal length of the insertion portion 510 with respect to the bottom of the first outer case 110.

The decor member 500 may be made of a plastic material, and for example, may be made of a polyvinyl chloride (PVC) material. Specifically, by using the PVC material, the decor member 500 may be formed in the same or similar to the texture and color of the inner cases 160 and 260. In some implementations, the decor member 500 may have the same color as the inner cases 160 and 260, so that when the user opens a door, the first refrigerator 100 and the second refrigerator 200 may be felt in a connected state, creating a sense of unity.

On the other hand, it is preferable that the insertion portion 510 is made of a hard plastic to be robust such that the shape of the decor member 500 can be maintained in the space S1 between the refrigerators. For example, the insertion portion 510 may be made of a hard PVC having a hardness of 70 to less than 100. The rear decor 512 may also be made of the same material as the insertion portion 510.

In some implementations, since the side ribs 520 and the shielding portion 530 are to be in close contact with the first refrigerator 100 and the second refrigerator 200, it is preferable that they are made of a more flexible material than the insertion portion 510. For example, the side ribs 520 and the shielding portion 530 may be made of a soft PVC having a hardness of 50 to less than 70.

Next, the lower cover 610 and the front bracket 620 constituting an implementation of the present disclosure will be described in detail.

Figure 16:
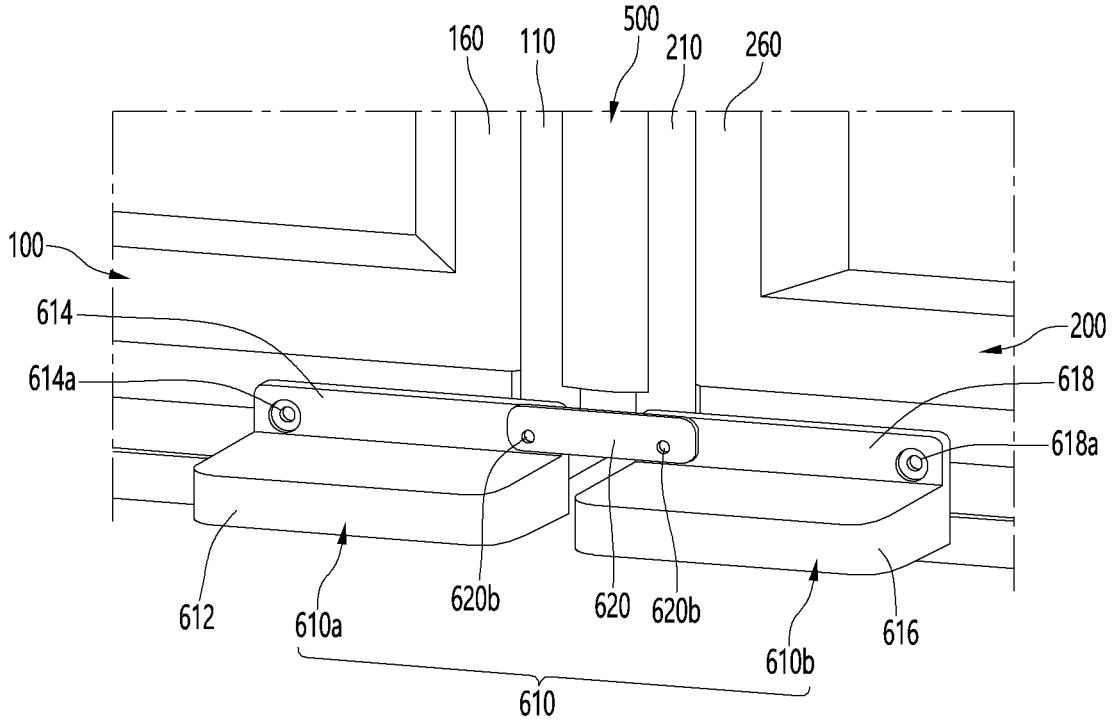
FIG. 16 is a front view showing a state in which a lower cover and a front bracket constituting an implementation of the present disclosure are mounted on the refrigerator.
Figure 17:
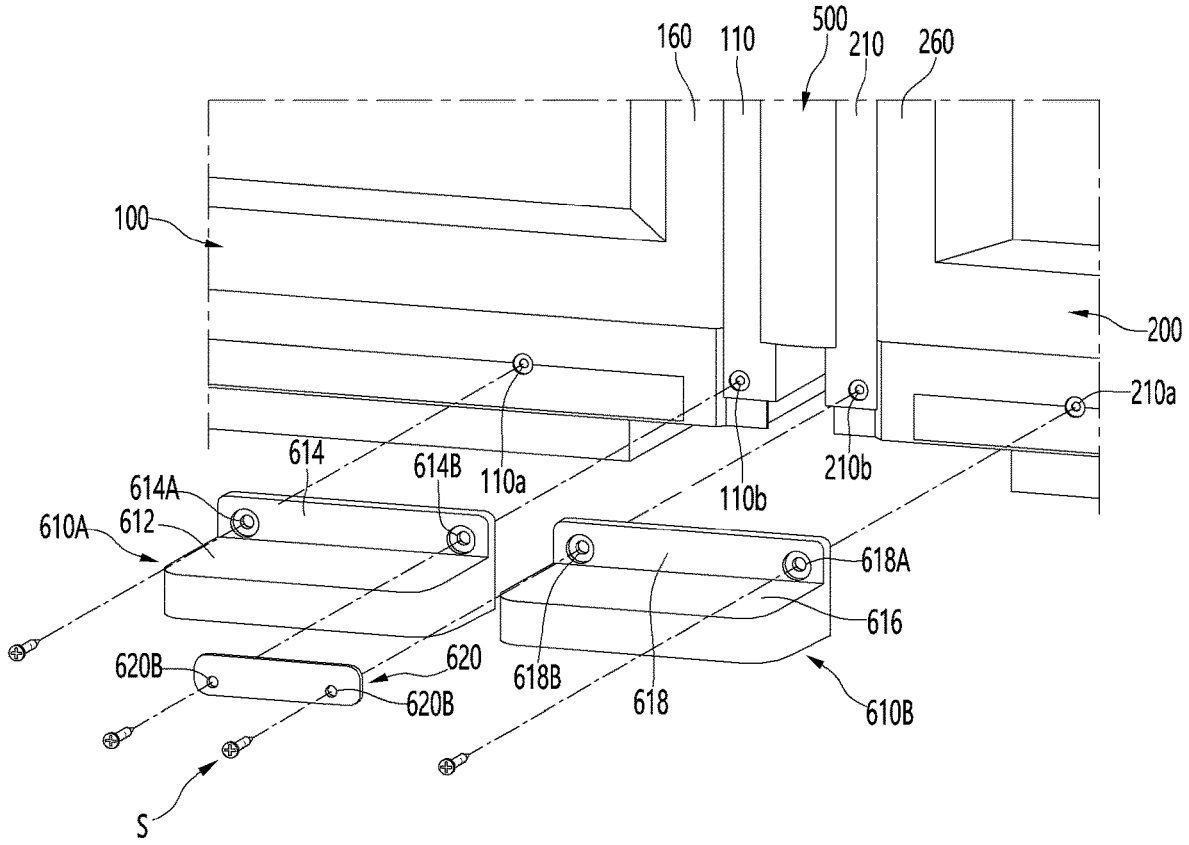
FIG. 17 is an exploded perspective view showing a coupling structure of the lower cover and the front bracket.

FIG. 16 is a front view showing a state in which a lower cover and a front bracket constituting an implementation of the present disclosure are mounted on a refrigerator. FIG. 17 is an exploded perspective view showing a coupling structure of a lower cover and a front bracket.

A refrigerator according to an implementation of the present disclosure may include a lower cover 610 on one side of a lower end of the outer case. Specifically, a first lower cover 610*a* and a second lower cover 610*b* may be respectively provided at one side of the lower ends of the first outer case 110 and one side of the second outer case 210 constituting the first refrigerator 100 and the second refrigerator 200.

The first lower cover 610*a* is installed on one side of the lower end of the first outer case 110. In some implementations, the first lower cover 610*a* may include a first coupling portion 614 extending horizontally with respect to the lower end of the first outer case 110 and coupled to the first outer case 110, and a first bottom portion 612 protruding forward from a lower end of the first coupling portion.

The second lower cover 610*b* is installed on one side of the lower end of the second outer case 210. In some implementations, the second lower cover 610*b* may include a second coupling portion 618 extending horizontally with respect to the lower end of the second outer case 110 and coupled to the second outer case 210, and a second bottom portion 616 protruding forward from a lower end of the second coupling portion 618.

The first lower cover 610*a* and the second lower cover 610*b* may be disposed on both sides of the space S1 between the first cabinet 10 and the second cabinet 20.

Since the first and second lower covers 610*a* and 610*b* are installed in the same manner in the first refrigerator 100 and the second refrigerator 200, a description will be given based on the first lower cover 610*a* installed in the first refrigerator 100.

The first lower cover 610*a* may include a first coupling portion 614 extending horizontally with respect to the lower end of the first outer case 110 and coupled to one side of a lower end of the first outer case 110, and a bottom portion 612 protruding forward from a lower end of the first coupling portion 614.

The coupling portion 614 may have a rectangular plate shape with rounded corners. The rear surface of the coupling portion 614 may be coupled to the front surface of the first outer case 110.

In some implementations, a pair of coupling holes 614*a* and 614*b* through which fastening members pass may be provided at both sides of the coupling portion 614. Among the pair of coupling holes 614*a* and 614*b*, the fastening member passes through the coupling hole 614*b* close to the space S1 between the refrigerators and is coupled to the front bracket 620 to be described later and the first outer case 110.

In some implementations, the other coupling hole 614*a* may be coupled to a first case hole 110*a* formed at the lower end of the first outer case 110 by a fastening member. Of course, the coupling hole 618*a* provided in the second lower cover 610*b* may be penetrated by a fastening member and may be coupled to the first case hole 210*a* formed at the lower end of the second outer case 210.

The bottom portion 612 may protrude forward from the lower end of the front surface of the coupling portion 614, and the lower end of the bottom portion 612 may extend to a bottom surface on which the refrigerator is installed. That is, the bottom portion 612 may serve to support the refrigerator from the lower side.

The door may be disposed above the bottom portion 612. That is, when the door is completely closed, the upper surface of the bottom portion 612 may be completely covered by the door.

The rear end of the bottom portion 612 may be connected to the front surface of the coupling portion 614, and a corner connecting the front surface and the side surface of the bottom portion 612 may have a smoothly rounded curve.

The first lower cover 610*a* and the second lower cover 610*b* may be connected to the front bracket 620. That is, the refrigerator may include a front bracket 620 coupled to the first lower cover 610*a* and the second lower cover 610*b* at both ends to fix the first refrigerator 100 and the second refrigerator 200 to maintain a set interval (S1).

In detail, the first lower cover 610*a* and the second lower cover 610*b* are respectively connected to the first outer case 110 and the second outer case 210 at one sides of the lower ends thereof. The front bracket 620 is coupled at one side of the first lower cover 610*a* and one side of the second lower cover 610*b* to connect and fix the first refrigerator 100 and the second refrigerator 200 with each other.

One side end of the first lower cover 610*a* may be positioned on the same line as one side end of the first outer case 110, and one side end of the second lower cover 610*b* may be positioned on the same line as one side end of the second outer case 210. That is, the first lower cover 610*a* and the second lower cover 610*b* may be positioned at both side ends of the space S1 between the refrigerators.

The front bracket 620 may have a rectangular plate shape with rounded corners. The front bracket 620 may be formed to have a vertical length corresponding to a vertical length of the coupling portion of the lower cover 610 with respect to the lower end of the first outer case 110.

In some implementations, the front bracket 620 may be formed to have a horizontal length longer than the horizontal length of the space S1 between the refrigerators, with respect to the lower end of the first outer case 110.

The rear surface of the front bracket 620 may be in contact with the rear surfaces of the coupling portions 614 and 618 of the lower cover. The lower end of the front bracket 620 may be disposed in contact with the upper ends of the bottom portions 612 and 616 of the first lower cover 610*a* and the second lower cover 610*b*.

The front bracket 620 may include a pair of bracket holes 620*b*, through which fastening members pass, at both sides. One of the pair of bracket holes may be connected to a coupling hole 614*b* of the first lower cover 610 by a fastening member, and the other bracket hole may be connected to a coupling hole 618*b* of the second lower cover 610 by a fastening member. In some implementations, the bracket holes 620*b* may be connected to second case holes 110*b* and 210*b* provided in the first outer case 110 and the second outer case 210 by fastening members.

The first lower cover 610, the second lower cover 610, and the upper end of the front bracket 620 may be positioned on the same line in a horizontal direction with respect to the lower end of the first outer case 110.

In some implementations, a lower end of the decor member 500 may be positioned above the first and second lower covers 610 and the front bracket 620.

Next, a top bracket 700 constituting another implementation of the present disclosure will be described in detail.

Figure 18:
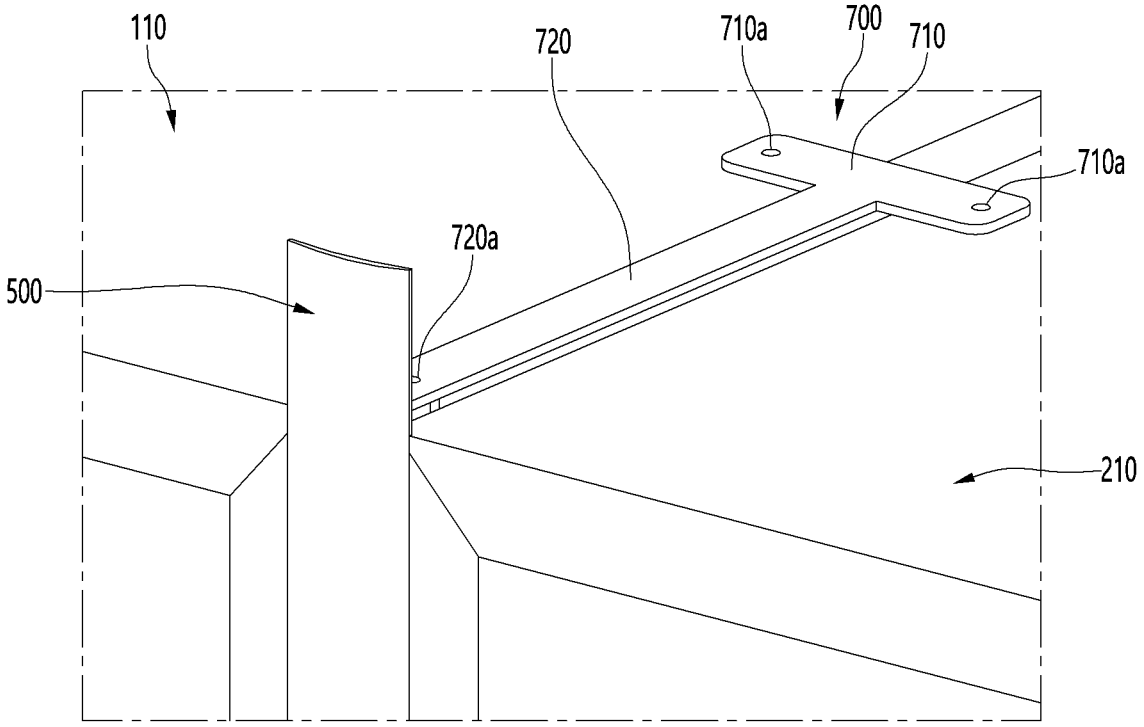
FIG. 18 is a perspective view showing a top bracket and a decor member according to another implementation of the present disclosure, as viewed from above.
Figure 19:
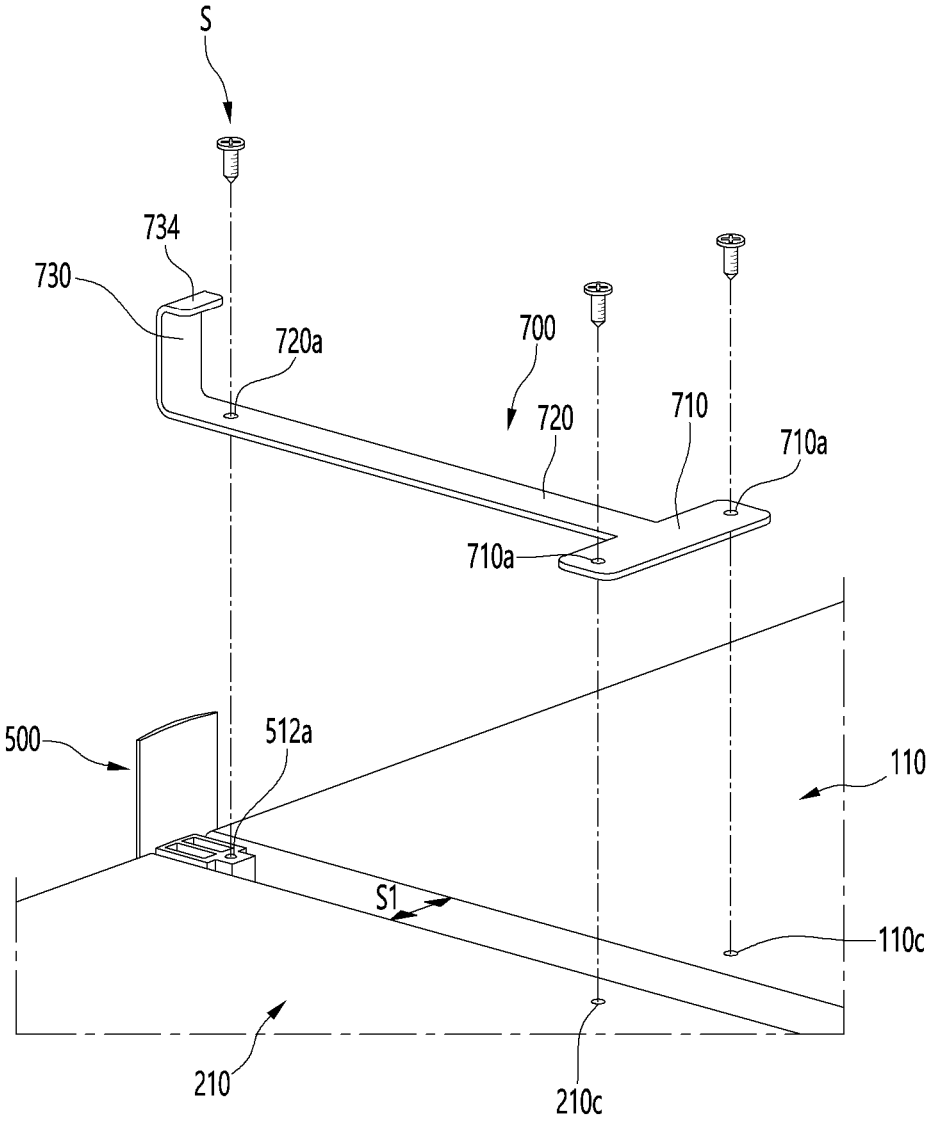
FIG. 19 is an exploded perspective view showing a coupling structure of the decor member and the top bracket.

FIG. 18 is a perspective view showing a top bracket and a decor member according to another implementation of the present disclosure, as viewed from above. FIG. 19 is an exploded perspective view showing a coupling structure of the decor member and the top bracket.

A refrigerator according to another implementation of the present disclosure may include a decor member 500 in front of the space S1 between refrigerators, and the top bracket 700 is connected to the upper end of the decor member 500, so that the decor member 500 is coupled more firmly to the first refrigerator 100 and the second refrigerator 200.

That is, the refrigerator according to an implementation of the present disclosure may include a top bracket 700 arranged to cross a space between the first cabinet 10 and the second cabinet 20 such that both ends thereof are coupled to the upper surface of the first cabinet and the upper surface of the second cabinet and the first cabinet 10 and the second cabinet 20 maintain a set distance (S1).

The top bracket 700 may include a bracket body 720 formed to extend in a front-rear direction with respect to a lower end of the first outer case 110, and provided on an upper surface of the space S1 between the refrigerators, and a bracket coupling portion 710 extending from the rear end to both sides and coupled to the first outer case 110 and the second outer case 210.

In other words, the top bracket 700 may include a bracket body 720 extending along a space between the first cabinet 10 and the second cabinet 20 and a bracket coupling portion 710 extending from the rear end of the bracket body 720 to both sides and coupled to the first cabinet 10 and the second cabinet 20.

The upper end of the bracket body 720 may be positioned above the front end of the insertion portion 510. One side end of the bracket body 720 may be positioned above one side end of the upper surface of the first outer case 110. Further, the other side end of the bracket body 720 may be positioned above one side end of the upper surface of the second outer case 110. That is, the bracket body 720 may shield a part or all of the upper surface of the space S1 between the refrigerators.

In some implementations, the bracket body 720 may include a first bracket connection hole 720*a* through which a fastening member, which passes through the connection hole 512*a* of the decor member 500, passes. The first bracket connection hole 720*a* may be provided at a position corresponding to the connection hole 512*a* of the decor member 500 in a front portion of the bracket body 720. Thus, the top bracket 700 may be coupled to the decor member 500 in such a way that fastening members pass through a first bracket connection hole 720*a* and the connection hole 512*a* of the decor member 500.

The bracket body 720 may shield the opening of the decor member 500 from above, thereby preventing foreign matters from entering through the opening.

The bracket coupling portion 710 is formed to extend in both sides from the rear end of the bracket body 720. That is, the bracket coupling portion 710 may be formed to across the first outer case 110 and the second outer case 210.

A pair of second bracket connection holes 710*a* connected to the first outer case 110 and the second outer case may be provided at both sides of the bracket coupling portion 710. One of the pair of second bracket connection holes 710*a* may be connected to a connection hole 110*c* formed in an upper surface of the first outer case 110 by a fastening member. In some implementations, the other of the second bracket connection holes 710*a* may be connected to a connection hole 210*c* formed in the upper surface of the second outer case 210 by a fastening member.

That is, the bracket coupling portion 710 is connected to the first and second outer cases 210 to more firmly fix the first refrigerator 100 and the second refrigerator 200 from the top.

The top bracket 700 may include a bent portion 730 that is bent and extending upward from a front end of the bracket body 720 and coupled to the decor member 500.

The front surface of the bent portion 730 may be positioned in contact with the rear surface of the shielding portion 530. The shielding part 530 may be formed to further extend upward from the front portion 511 of the insertion portion 510, and the bent part 730 may serve to support the shielding portion 530 from the rear. Accordingly, the shielding portion 530 may be maintained in shape without being bent, due to the bent portion 730.

The bent portion 730 may further include an extension portion 734 formed to bent and extending rearward from the upper end of the bent portion 730. The extension portion 734 may extend to the front of the first bracket connection hole 720*a*.

A refrigerator according to another implementation of the present disclosure may be installed in the following manner. The first and second lower covers 610*a* and 610*b* may be arranged at lower ends of the first refrigerator 100 and the second refrigerator 200, and a front bracket 620 may be arranged in the front of the first and second lower covers 610*a* and 610*b* and fasten thereto with a screw (S).

The top bracket 700 may be disposed between the tops of the first refrigerator 100 and the second refrigerator 200, and the top bracket 700 is fastened and fixed by a screw passing through the second bracket connection hole 710*a*. The decor member 500 may be fitted to the upper end of the space S1 between first and second refrigerators 100 and 200, and then assembled to the upper end of the space between the refrigerators 100 and 200 while being in close contact with the both sides of the refrigerators 100 and 200. Thereafter, the decor member 500 may be fixed and installed by a screw (S) passing through the first bracket connection hole 720*a* and the connection hole 512*a* of the insertion portion 510.

When two or more refrigerators are installed in parallel, that is, when a pair installation type refrigerator is installed, the decor member 500 creates an effect of having a beautiful appearance by forming a sense of unity in the appearance of two or more refrigerators.

In some implementations, the decor member 500 may include a through portion 510*a* communicating the upper end and lower end of the insertion portion 510, which can facilitate insertion into the space between a refrigerator and a refrigerator and transportation.

The decor member 500 is formed to have a structure in which the side ribs 522 are inclined forward as they go toward sides, so that there is an advantage of easy insertion of the decor member 500 into the space between the first refrigerator 100 and the second refrigerator 200.

The decor member 500 may have a support hole 516*a* in the center of the insertion portion 510, and a support wire made of a metal material may be inserted into the support hole 516*a*, so that damage is reduced or minimized to the decor member 500 during the transportation and installation process.

The decor member 500 may include a shielding portion 530 connected to the front surface of the insertion portion 510 and extending to both sides of the insertion portion 510 to connect one side of the first refrigerator 100 and one side of the second refrigerator 200 and shield the space between the refrigerators from the front.

The shielding portion is formed to protrude to be convex forward and to be inclined rearward toward both sides, so that the decor member 500 has the advantage of minimizing the user's sense of heterogeneity between the refrigerator and the decor member.

The decor member 500 may include a rear decor 512 protruding rearward from the rear surface of the insertion portion 510 and including a connection hole, and is coupled to the upper bracket 700, thus making the fixing between the first refrigerator and the second refrigerator and fixing between the refrigerator and the decor member 500 more robust.

In addition, implementations of the present disclosure may include a first lower cover 610*a* and a second lower cover 610*b* on one side of a lower end of the first refrigerator and one side of a lower end of the second refrigerator, respectively, and the front bracket 620 may be connected to the first lower cover 610*a* and the second lower cover 610*b*, thus fixing the first refrigerator 100 and the second refrigerator 200 even at the lower end.

In addition, implementations of the present disclosure has an advantage in that the first refrigerator 100 and the second refrigerator 200 can be more firmly fixed by providing the upper bracket 700 on the upper surface of the space between the refrigerators.

The refrigerator according to the implementations of the present disclosure is described by taking, as an example, a pair installation type a refrigerator in which at least two refrigerators are arranged in parallel at a set interval, but is not limited thereto.

For example, the refrigerator according to the present disclosure may be a built-in type refrigerator that can be integrally mounted with furniture disposed indoors or a wall on which exteriors are formed.

In detail, even when the refrigerator is installed alone and in close contact with a wall surface, or is in close contact with furniture during built-in installation, the air discharged from the machine room can be discharged along the outer side wall of the outer case by the flow guide, thus preventing dew condensation phenomenon on a side of the refrigerator. In some implementations, two or more refrigerators may have an elegant appearance by forming a sense of unity in appearance by providing the decor member.

The refrigerator according to the implementations of the present disclosure can expect the following effects.

In the refrigerator according to the present disclosure, a flow guide formed on the side of the outer case may guide air discharged from the machine room through the discharge portion to be discharged toward the upper portion of the outer case.

Accordingly, dew condensation phenomenon can be restricted by increasing the dew point of the side of the outer case by using the heat source of the air.

Specifically, the dew condensation phenomenon occurring on the side of the refrigerator can be restricted when refrigerators are arranged in parallel at regular intervals or installed close to a wall surface.

In some implementations, when two or more refrigerators are installed in parallel, that is, when a pair installation type refrigerator is installed, the refrigerator according to the present disclosure includes a decor member at the front of one side of the refrigerator, so that two or more refrigerators form a sense of unity in appearance, providing a beautiful appearance.

The decor member may include a through portion communicating the upper end and lower end of the insertion portion, which can facilitate insertion into the space between a refrigerator and a refrigerator and transportation.

The decor member is formed to have a structure in which the side ribs are inclined forward as they go toward sides, so that the decor member can be easily inserted into the space between the first refrigerator 100 and the second refrigerator.

What is claimed is:

1. A refrigerator system comprising:

a first refrigerator including:

a first cabinet defining a first storage space;

a first door configured to open and close the first storage space;

a first hinge coupled to the first cabinet and configured to rotate the first door relative to the first cabinet;

a first machine room disposed under the first cabinet;

a first discharge portion disposed at a first side wall of the first cabinet and in fluid communication with the first machine room; and a flow guide detachably coupled to the first side wall of the first cabinet and covering the first discharge portion; and a second refrigerator including:

a second cabinet spaced apart from the first cabinet and defining a second storage space;

a second door configured to open and close the second storage space;

a second hinge coupled to the second cabinet and configured to rotate the second door relative to the second cabinet, wherein the second door is configured to open symmetrically to an opening direction of the first door;

a second machine room disposed under the second cabinet; and a second discharge portion disposed at a second side wall of the second cabinet and in fluid communication with the second machine room, wherein the flow guide includes:

a guide body, and a guide inner surface that faces the first discharge portion, wherein the guide body includes (i) a first edge portion that defines a bottom surface of the flow guide and (ii) a second edge portion and a third edge portion that extend upward from the first edge portion at opposite sides of the flow guide and define side surfaces of the flow guide.

2. The refrigerator system of claim 1, wherein the flow guide is open upward and configured to guide air discharged from the first discharge portion upward along the first side wall of the first cabinet.

3. The refrigerator system of claim 1, wherein the flow guide includes a sealing frame that protrudes from the guide inner surface and is spaced apart from the first, second, and third edge portions of the guide body, and wherein a sealing member is disposed between the sealing frame and the first, second, and third edge portions of the guide body.

4. The refrigerator system of claim 1, wherein the flow guide includes a restrainer that protrudes from the guide inner surface and that is configured to connect the flow guide and the first discharge portion.

5. The refrigerator system of claim 1, wherein the flow guide includes an insertion guide protruding toward the guide inner surface and contacting an end of the first discharge portion to guide a direction in which the flow guide is inserted into the first discharge portion.

6. The refrigerator system of claim 1, wherein the flow guide protrudes from the guide inner surface and includes a guide rib that extends in a direction crossing the first edge portion of the guide body.

7. The refrigerator system of claim 6, wherein the guide rib includes:

a first guide rib portion that is perpendicular or inclined to the first edge portion;

a second guide rib portion that has an obtuse angle with respect to the first edge portion;

a third guide rib portion that is perpendicular or inclined to the first edge portion; and a fourth guide rib portion that has an acute angle with the first edge portion.

8. The refrigerator system of claim 1, further comprising a decor configured to be disposed between the first refrigerator and the second refrigerator and shield a front side of the first refrigerator and the second refrigerator that are disposed side by side, wherein the decor includes:

an insertion portion configured to be disposed between the first refrigerator and the second refrigerator, and a shielding portion (i) extending from a front end of the insertion portion to opposite sides of the insertion portion and (ii) supported at a front surface of the first cabinet and a front surface of the second cabinet.

9. The refrigerator system of claim 8, wherein the insertion portion includes a through portion that is in fluid communication with an upper end and a lower end of the insertion portion.

10. The refrigerator system of claim 8, wherein the insertion portion includes:

a front portion defining a front surface of the insertion portion;

a side portion extending away from the front portion and defining the opposite sides of the insertion portion;

a rear portion connected to the side portion and defining a rear portion of the insertion portion; and a central portion extending away from a center of the front portion and connected to a center of the rear portion.

11. The refrigerator system of claim 10, wherein the central portion defines a support hole that extends from an upper end of the central portion to a lower end of the central portion.

12. The refrigerator system of claim 8, wherein the decor includes side ribs protruding outward from the opposite sides of the insertion portion.

13. The refrigerator system of claim 12, wherein each of the side ribs is inclined toward the shielding portion as it extends from one of the opposite sides of the insertion portion.

14. The refrigerator system of claim 1, wherein the first refrigerator includes a first lower cover that is disposed at a lower end of a front surface of the first cabinet, the first lower cover including:

a first coupling portion extending parallel with a lower end of the first cabinet and coupled to the first cabinet, and a first lower surface portion protruding forward from a lower end of the first coupling portion, wherein the second refrigerator includes a second lower cover that is disposed at a lower end of a front surface of the second cabinet, the second lower cover including:

a second coupling portion extending parallel with a lower end of the second cabinet and coupled to the second cabinet, and a second lower surface portion protruding forward from a lower end of the second coupling portion.

15. The refrigerator system of claim 14, further comprising a front bracket that is coupled to the first lower cover and the second lower cover at opposite ends of the front bracket, and that is configured to fix the first and second cabinets and maintain a set distance between the first and second cabinets.

16. A refrigerator system comprising:

a first refrigerator including:

a first cabinet defining a first storage space, and a first door configured to open and close the first storage space, a second refrigerator including:

a second cabinet spaced apart from the first cabinet and defining a second storage space, and a second door configured to open and close the second storage space;

a decor configured to be disposed between the first refrigerator and the second refrigerator and shield a front side of the first refrigerator and the second refrigerator that are disposed side by side;

a top bracket configured to be coupled to an upper surface of the first cabinet and an upper surface of the second cabinet, wherein the top bracket includes:

a bracket body extending along a space between the first and second cabinets, and a bracket coupling portion extending from a rear end of the bracket body to opposite sides of the bracket body and coupled to the first cabinet and the second cabinet.

17. The refrigerator system of claim 16, wherein the top bracket further includes a bent portion extending upward from a front end of the bracket body and contacting the decor.

18. The refrigerator system of claim 16, wherein the decor includes a rear decor that protrudes rearward from a rear end of an insertion portion and that defines a connection hole that is fluidly connected to the top bracket, wherein the top bracket defines a bracket connection hole, and wherein a screw is fastened through the connection hole and the bracket connection hole.

* * * * *